US011232720B2

(12) United States Patent
Le

(10) Patent No.: US 11,232,720 B2
(45) Date of Patent: Jan. 25, 2022

(54) DISPLAY HOLDERS AND ADAPTERS SYSTEM

(71) Applicant: BBY Solutions, Inc., Richfield, MN (US)

(72) Inventor: Adam Le, Shakopee, MN (US)

(73) Assignee: BBY Solutions, Inc., Richfield, MN (US)

( * ) Notice: Subject to any disclaimer, the term of this patent is extended or adjusted under 35 U.S.C. 154(b) by 0 days.

(21) Appl. No.: 16/862,860

(22) Filed: Apr. 30, 2020

(65) Prior Publication Data

US 2021/0343191 A1 Nov. 4, 2021

(51) Int. Cl.
*G09F 3/08* (2006.01)
*G09F 9/30* (2006.01)

(52) U.S. Cl.
CPC . *G09F 3/08* (2013.01); *G09F 9/30* (2013.01)

(58) Field of Classification Search
CPC ..... G09F 3/08; G09F 9/30; G09F 3/204
See application file for complete search history.

(56) References Cited

U.S. PATENT DOCUMENTS 5,511,332 A * 4/1996 Sturkie ..... G09F 7/10 248/223.41
5,764,200 A 6/1998 Odmark
5,853,196 A 12/1998 Wilkus
5,946,839 A 9/1999 Odmark
6,035,569 A 3/2000 Nagel
6,069,596 A 5/2000 Marvin
6,279,256 B1 8/2001 Norolof
6,553,702 B1 * 4/2003 Bacnik ..... G09F 3/204 40/649
6,698,701 B1 3/2004 Dalton
D512,104 S * 11/2005 Lowry ..... D20/44
7,287,350 B2 10/2007 Fast
7,900,387 B2 3/2011 Lee
8,141,283 B2 3/2012 Lee
8,627,588 B2 1/2014 Rosander
8,683,723 B2 4/2014 Sjödin et al.
9,984,593 B2 5/2018 Jubro
10,453,362 B2 10/2019 Bottine
2002/0146282 A1 * 10/2002 Wilkes ..... A47F 5/0068 403/331
2004/0178308 A1 * 9/2004 Bacnik ..... G09F 3/204 248/223.41
2004/0262470 A1 * 12/2004 Lowry ..... G03B 21/00 248/205.1
2009/0134103 A1 5/2009 Saxena
2018/0268745 A1 9/2018 De Haas
2021/0090471 A1 * 3/2021 Kim ..... F16B 2/22

* cited by examiner

*Primary Examiner* — Cassandra Davis
(74) *Attorney, Agent, or Firm* — Forsgren Fisher; James M. Urzedowski; Daniel A. Tysver

(57) ABSTRACT

Systems, methods and apparatuses are presented that provide a modular mechanism for securing and displaying ESL devices from a variety of structures and surfaces common to a commercial environment. Included are different types of holders for supporting different types of ESL devices, and a variety of types of surface adapters, each of which are uniquely configured for securement to a surface or structure, but which also have a uniform system of engagement that allows their use with any of the holders.

13 Claims, 25 Drawing Sheets

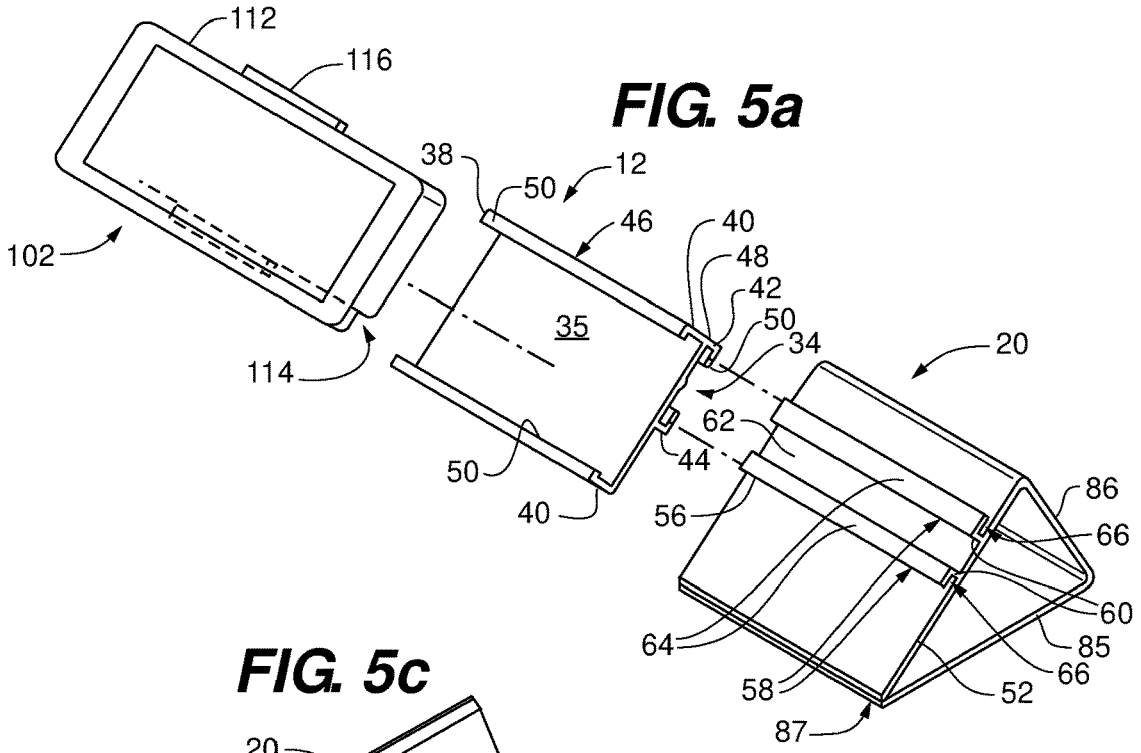
FIG. 5a
FIG. 5c
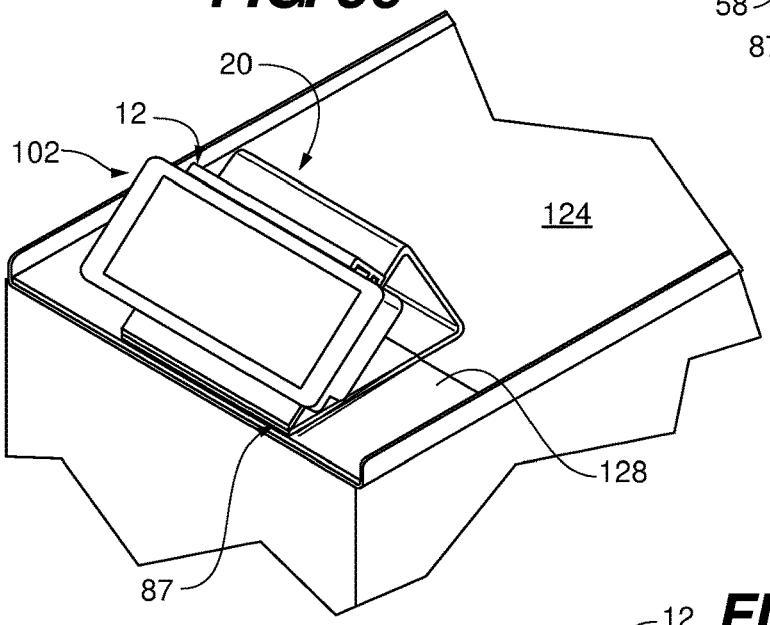
FIG. 5b
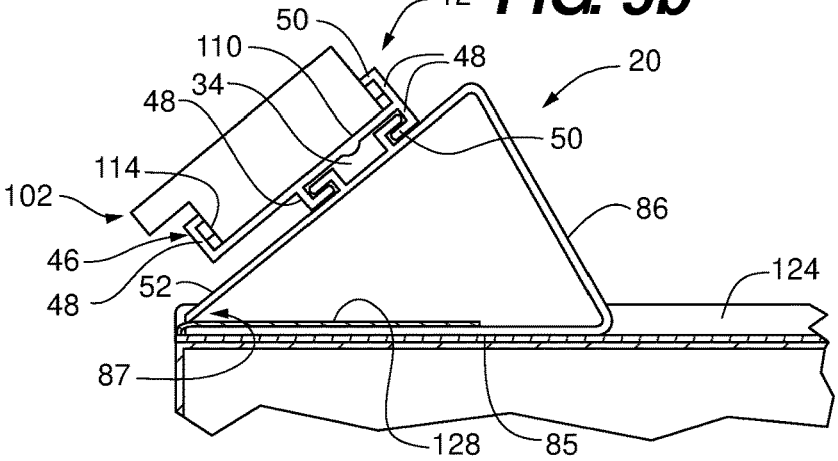

DISPLAY HOLDERS AND ADAPTERS SYSTEM

FIELD OF THE INVENTION

Embodiments disclosed herein relate to a system of holders and adapters for attaching and displaying Electronic Shelf Labels (ESLs), fact tags, display monitors, or other informational displays in a commercial setting such as a retail store.

BACKGROUND OF THE INVENTION

From retail stores to wholesale warehouses and other commercial settings, the products available therein as well as the displays of those products are in a seemingly constant state of change. As a consequence, many commercial entities have moved to the use of electronic shelf labels (ESLs) that have easily reprogrammable informational displays that allow a seller to change the information displayed to potential customers in a more fluid manner than conventional labels. ESLs may be provided in a variety of shapes and sizes, and may be programmed to display anything from basic product information akin to a more conventional label (e.g. price, quantity, etc.) to full audio/visual commercial programing, depending on their level of complexity.

In modern commercial environments, particularly those of retail stores, the shelving, product displays and even product packaging provide a diverse array of surfaces upon which and against an ESL may be mounted. To accommodate this diversity of potential mounting surfaces, various specialized ESL holders and adapters have been proposed, such as, for example, those described in U.S. Pat. Nos. 5,853,196; 6,935,062 and 8,627,588.

While known ESL holders, such those in the examples provided above, may provide mechanisms for securing ESLs to specific surfaces common to a retail or wholesale setting (e.g. directly to shelf face, the C-channel of a retail shelf, and the edge of a shelf) there remains a need for an ESL mounting system that is capable of supporting one or more types of ESL devices and which is capable of being used on or against a wide variety of surfaces common to a retail setting. The system disclosed herein meets this need.

SUMMARY OF THE INVENTION

Embodiments disclosed herein are directed to a "universal" ESL mounting and display system. The system is comprised of ESL holders and adapters. The holders and adapters are molded or extruded components (preferably of PVC or ABS plastic, although materials having similar properties may be utilized). The ESL holders are configured to engage and display an ESL. The adapters are configured to receive the ESL holder and to secure it to, or upon, various surfaces in a commercial setting such as a retail store. By providing the system with holders capable of engaging various types and sizes of ESLs, and by providing adapters capable of supporting or attaching holders to a wide range of surfaces, the system provides a user with the ability to mount and display ESLs in a wide range of diverse locations within a commercial setting, such as a retail store.

BRIEF DESCRIPTION OF THE DRAWINGS

FIG. 5*a* is a schematic representation of the first type of holder and a third type of adapter as shown in FIG. 2, isometrically shown to depict their manner of engagement with one another and with the first type of ESL.

FIG. 5*b* is a side view of the first type of holder, third type of adapter, and first type of ESL as depicted in FIG. 5*a*, but shown fully assembled together and positioned upon a display surface.

FIG. 5*c*. is an isometric view of the assembled and surface supported first type of holder, third type of adapter, and first type of ESL shown in FIG. 5*b*.

DETAILED DESCRIPTION

As mentioned above, some embodiments disclosed herein are directed to systems for displaying ESL devices as well as the components which the systems are comprised of. Exemplary embodiments of the systems 10 are shown in FIGS. 1, 2 and 10, with the components of the systems, their features, and potential uses depicted in FIGS. 1-17.

Figure 1:
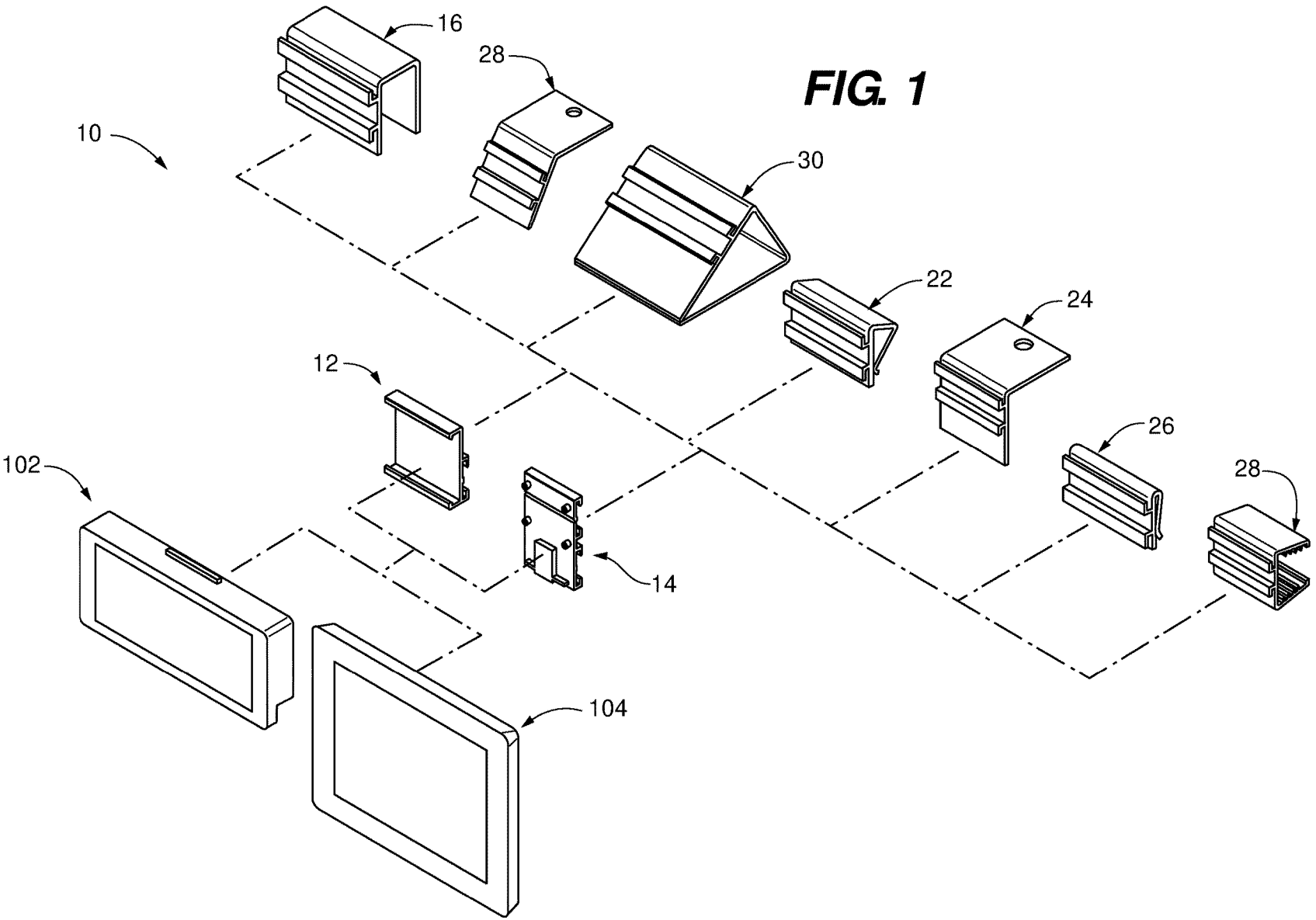
FIG. 1 is a schematic representation of an embodiment of the system having a first type of holder and a second type of holder, and seven types of adapters isometrically shown.

As depicted in the figures, some embodiments comprise one or more uniquely configured ESL "holders" such as first holder 12 and second holder 14 shown in FIG. 1. Each first holder 12 and 14 is provided with a central panel 36 with structures configured to allow the holder to engage an ESL device on one side of the panel, and structures configured to allow the holder to engage any of several types of adapters on the opposing side of the panel. Each holder 12 and 14 have unique structures on the ESL facing side of the panel 36 that are adapted to be engaged to and support (hold) a particular types of ESL device, such as for example an ESL tag 102 and an ESL display 104. While only two types of holders 12 and 14 and their corresponding types of ESLs 102 and 104 are depicted in FIG. 1, it is understood that other types of holders for supporting other types of ESLs may be included as part of the system 10 if such holders and ESLs are provided with the unique engagement mechanisms that will be discussed in greater detail below.

Each of the holders 12 and 14 are configured to be engaged individually, by any and all of the various types of "adapters" 16, 18, 20, 22, 24, 26, and 28 such as are shown in FIG. 1. While each type of adapter 16, 18, 20, 22, 24, 26, and 28 is configured to be capable of engaging with any type of holder, each type of adapter 16, 18, 20, 22, 24, 26, and 28 is uniquely configured for use with, upon, or against various structures and surfaces that may be present in a commercial environment, such as a wholesale or retail store; and which are depicted in greater detail in FIGS. 3*a*-9*d*. As with the holders and ESLs, it should be recognized and understood that the seven types of adapters shown and described herein represent mere examples of potential adapters that may be part of the system 10. Other types of adapters having the unique engagement mechanisms shown and described herein may be envisioned and would be within the scope of the disclosure.

Figure 2:
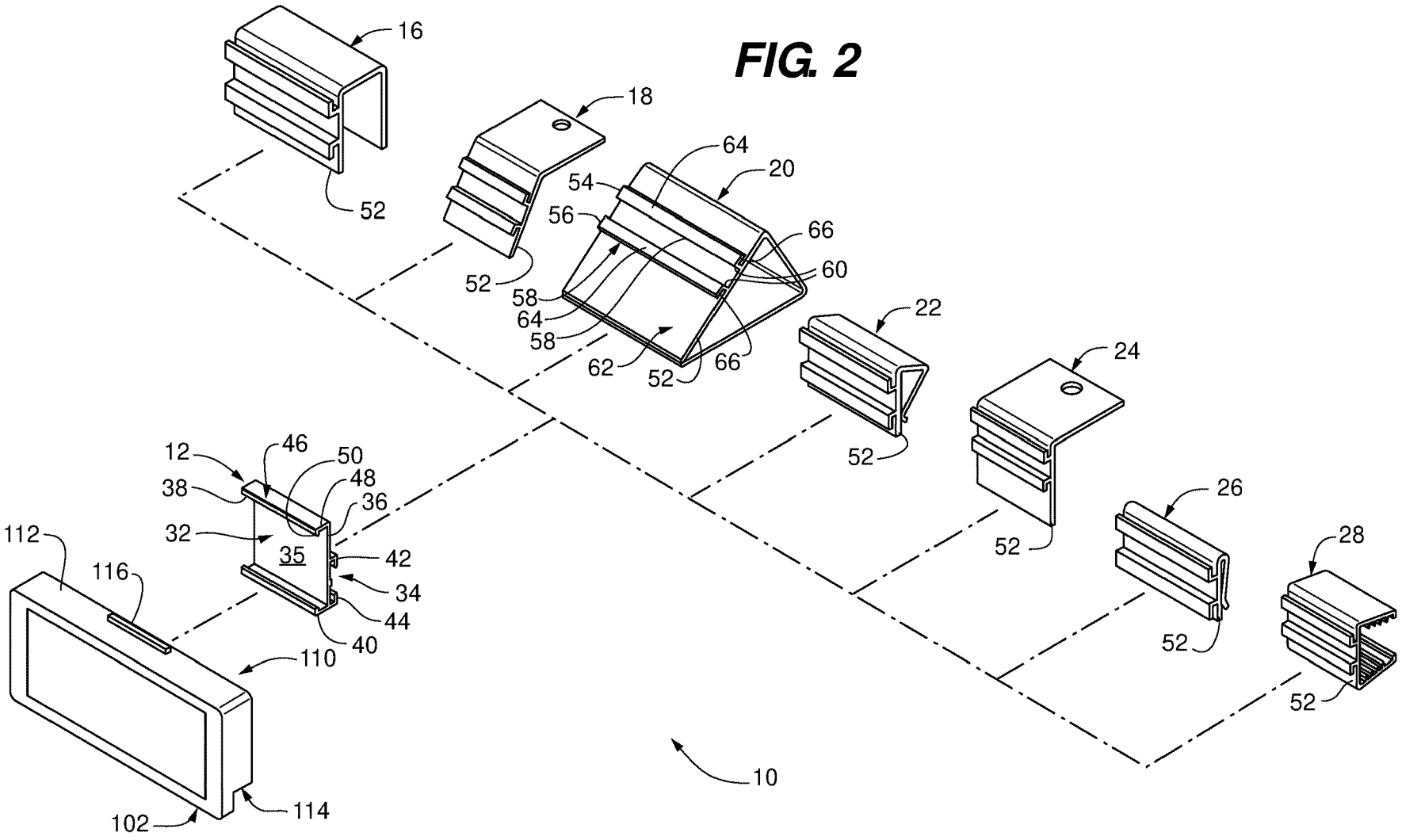
FIG. 2 is a schematic representation of an embodiment of the system having only the first type of holder, but all seven types of adapters shown in FIG. 1 isometrically shown.

While FIG. 1 represents an embodiment of a system 10 having multiple types of holders 12 and 14, in some embodiments, such as in a retail setting that only requires the use of a single type of ESL tag 102, the system 10 will likewise only utilize the first type of holder 12, such as is the case in the embodiment shown in FIG. 2. Similarly, in a setting where only ESL displays 104 are to be utilized, the system 10 will have only a second type of holder 14, such as is depicted in the embodiment shown in FIG. 10. In all such systems 10, any type of holder is capable of being engaged to any of the types of adapters 16, 18, 20, 22, 24, 26, and 28.

Such systems 10 may include less than the seven types of adapters shown and described, in accordance to the requirements of the commercial environment into which the system is employed.

A key element of the embodiments shown herein are the complementary engagement mechanisms that are present between the holders 12 and 14 each of the adapters 16, 18, 20, 22, 24, 26, and 28 that allow the various adapters to be interchangeably engaged to any one of the holders in order to create a system 10 whereby ESLs configured for engagement to a holder can be displayed from or upon the various surfaces and structures that each adapter is tailored for use with.

Beginning with the embodiment shown in FIG. 2, which illustrates a system 10 comprised of a first type of holder 12 and the adapters 16, 18, 20, 22, 24, 26, and 28, the structure and nature of the complementary engagement mechanisms between the holder and each of the adapters are illustrated in detail in FIGS. 3*a*-9*d*.

As may be seen in the various figures, the first holder 12 may be characterized as a panel 36 having structure comprising a front facing (ESL side) C-channel 32 and a rear facing (adapter side) C-channel 34.

The front facing C-channel 32 is defined by a panel 36, an upper ESL clasping member 38, and a lower ESL clasping member 40. The clasping members 38 and 40 extend outward from the panel 36 to form opposingly positioned ends of the front facing "C" shaped channel 32. On the other side of the first holder 12, the rear facing C-channel 34 is also partially defined by the panel 36, but includes an upper adapter clasping member 42 and a lower adapter clasping member 44. The clasping members 42 and 44 extend outward from the panel 36 to form opposingly positioned ends of the rear facing "C" shaped channel 34.

The ESL clasping members 38 and 40, and the adapter clasping members 42 and 44 are in the form of an L-shaped holder arm 46. This L-shaped arm structure 46 is common to all the clasping members and is comprised of an upper arm 48, which perpendicularly projects from the panel 36, and a lower arm 50, which perpendicularly projects from the end of the upper arm 48.

As implied by their designations, and illustrated in detail by the various embodiments shown in FIGS. 3*a*-9*d*, the upper ESL clasping member 38 and lower ESL clasping member 40 are dimensioned so as to be capable of clasping an ESL, such as ESL tag 102, when the ESL tag 102 is pushed or slid into the confines of the front facing C-channel 32. When attached to the ESL tag 102 in this manner, the front face 35 of the panel 36 is placed into contact with at least a portion of the back surface 110 of the ESL tag 102. At least a portion of the top surface 112 of the ESL tag is engaged by the upper ESL clasping member 38 and at least a portion of the bottom surface 114 of the ESL tag 102 is engaged by the lower ESL clasping member 40.

The material characteristics of the first holder 12 are such that while being a fairly rigid structure, there is, in some embodiments, sufficient flexibility within the panel 36 and clasping members 38 and 40 to allow the ESL tag 102 to be snap fit between the clasping members 38 and 40. In some embodiments, the ESL tag 102 includes, as part of the top surface 110 and/or bottom surface 114, an engagement structure such as a lip, ridge or other type of protrusion 116. Such a protrusion 116 is configured to fit within and against the L-shaped holder arm 46 of one or both of the clasping members 38 and 40, to effectively engage the ESL tag 102 against the front surface 35 of the panel 36.

In some embodiments, rather than a protrusion 116, tan ESL tag 102 may have other engagements features such as a groove or indent (not shown) that the lower arm 50 of the ESL clasping members 38 and 40 are sized to engage with.

The engagement of the ESL tag 102 to the front facing C-channel 32 is a purely mechanical engagement between the two devices, without the need of additional adhesives, or hook and loop material (e.g. VELCRO™); and while the engagement is a temporary one (i.e. the ESL tag 102 may be engaged to and removed from the front facing C-channel 32 multiple times), the resulting friction fit is sufficiently secure so that incidental handling or bumping will not dislodge the ESL tag 102 from the front facing C-channel 32.

Figure 3A:
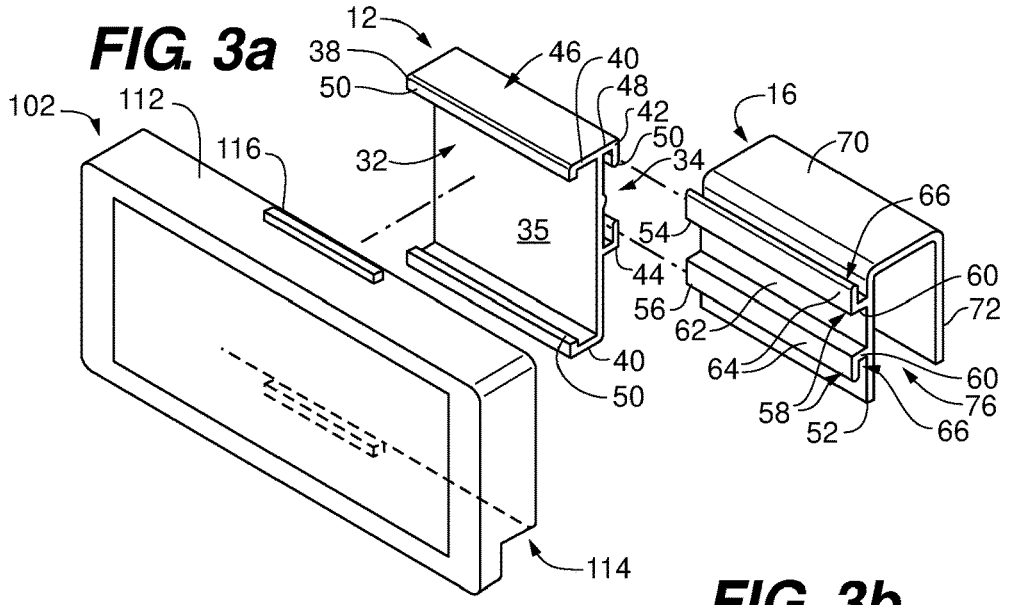
FIG. 3*a* is a schematic representation of the first type of holder and a first type of adapter as shown in FIG. 2, isometrically shown to depict their manner of engagement with one another and with a first type of ESL.
Figure 3B:
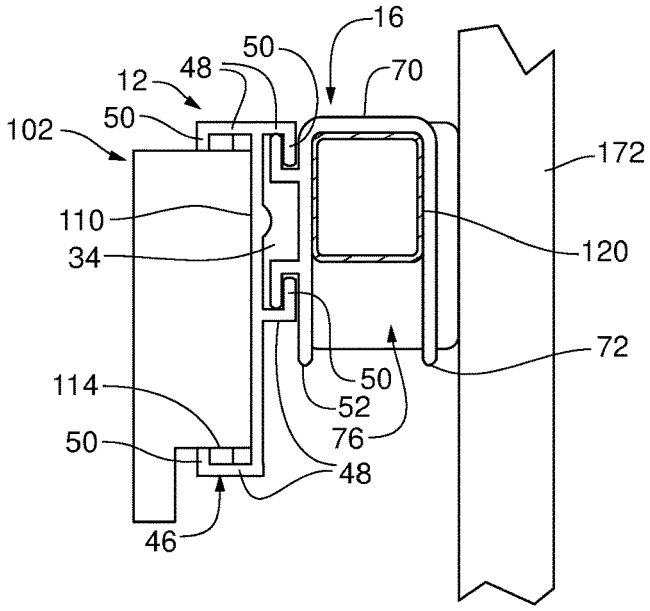
FIG. 3*b* is a side view of the first type of holder, first type of adapter, and first type of ESL as depicted in FIG. 3*a*, but shown fully assembled together and secured to a display bar.
Figure 3C:
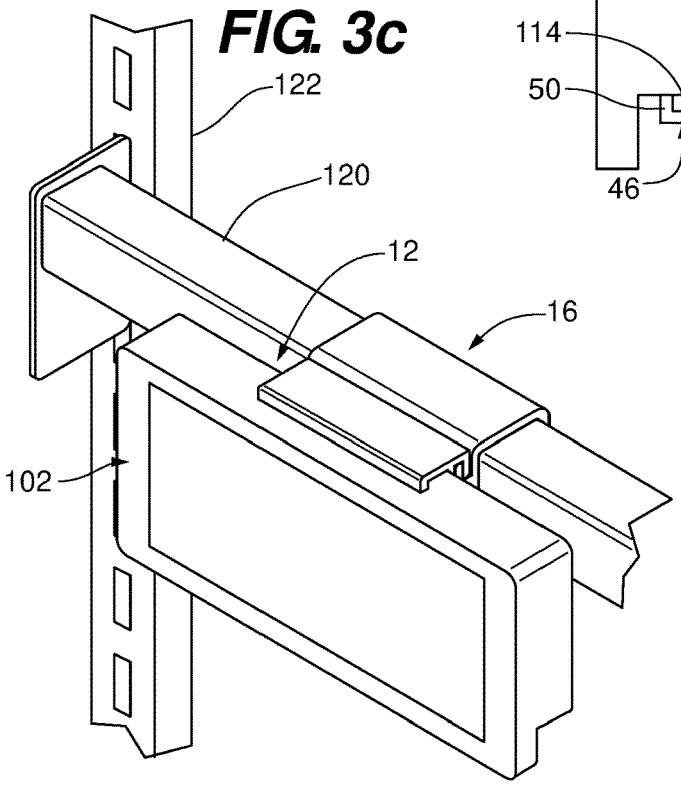
FIG. 3*c*. is an isometric view of the assembled and bar mounted first type of holder, first type of adapter, and first type of ESL shown in FIG. 3*b*.
Figure 4A:
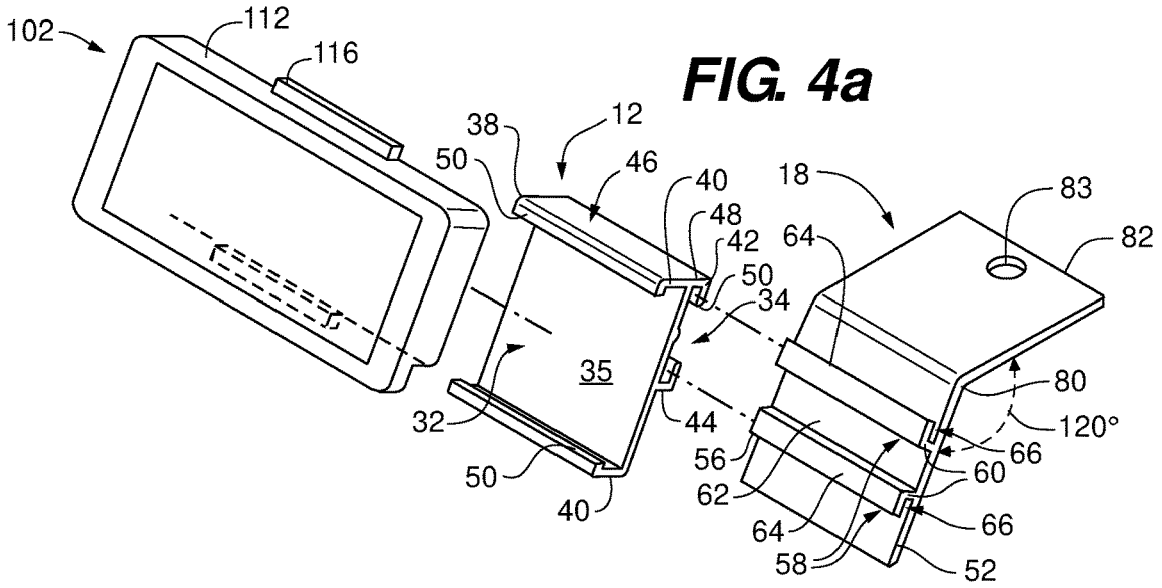
FIG. 4*a* is a schematic representation of the first type of holder and a second type of adapter as shown in FIG. 2, isometrically shown to depict their manner of engagement with one another and with the first type of ESL.
Figure 4C:
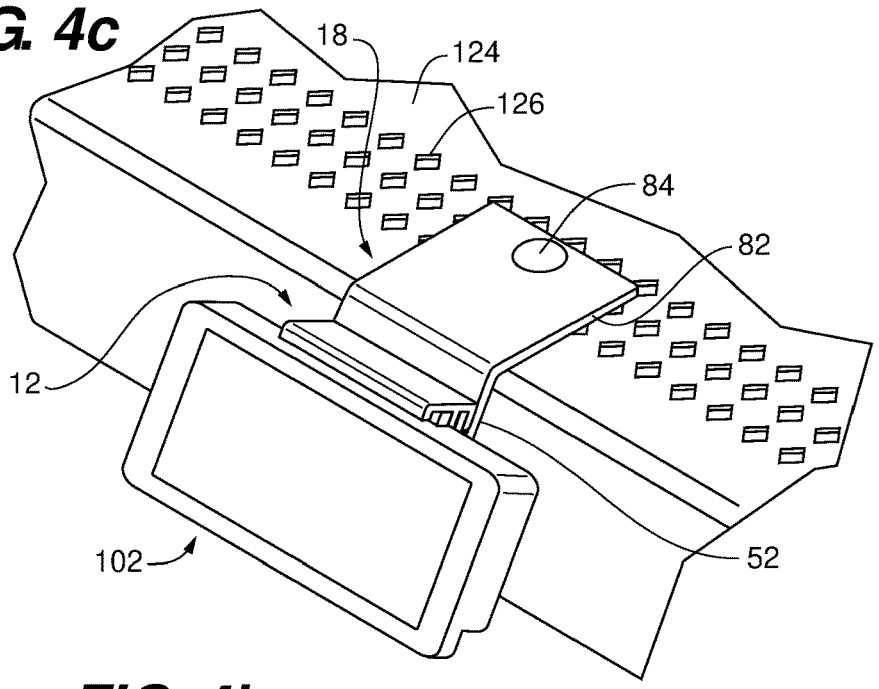
FIG. 4*c*. is an isometric view of the assembled and secured first type of holder, second type of adapter, and first type of ESL shown in FIG. 4*b*.
Figure 4B:
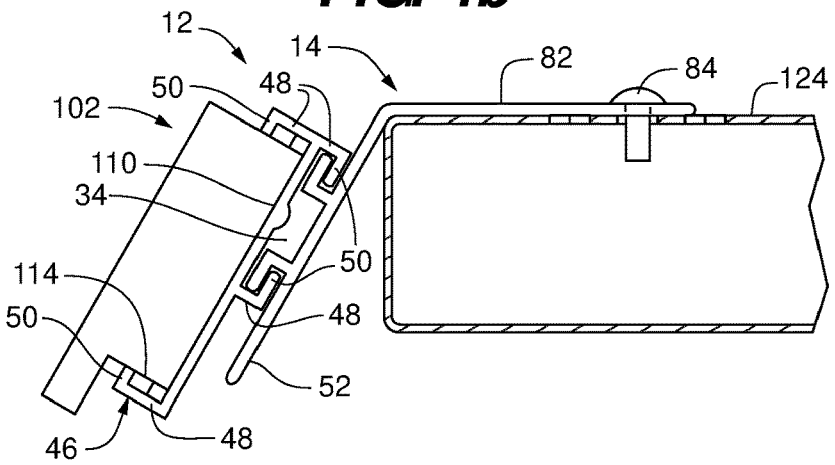
FIG. 4*b* is a side view of the first type of holder, second type of adapter, and first type of ESL as depicted in FIG. 4*a*, but shown fully assembled together and secured to a display surface.
Figure 6A:
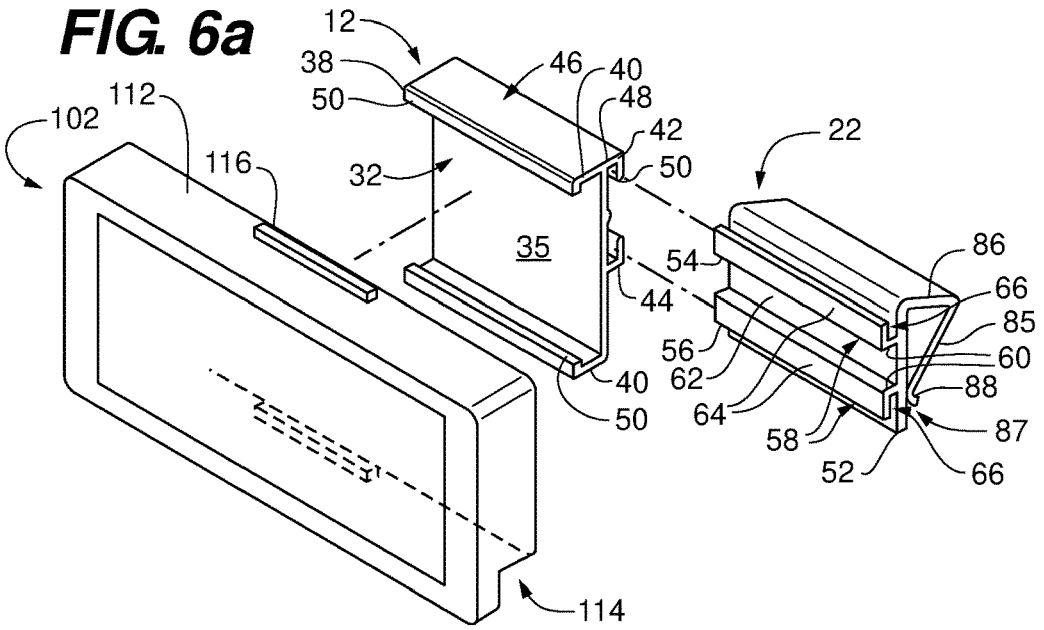
FIG. 6*a* is a schematic representation of the first type of holder and a fourth type of adapter as shown in FIG. 2, isometrically shown to depict their manner of engagement with one another and with a first type of ESL.
Figure 6C:
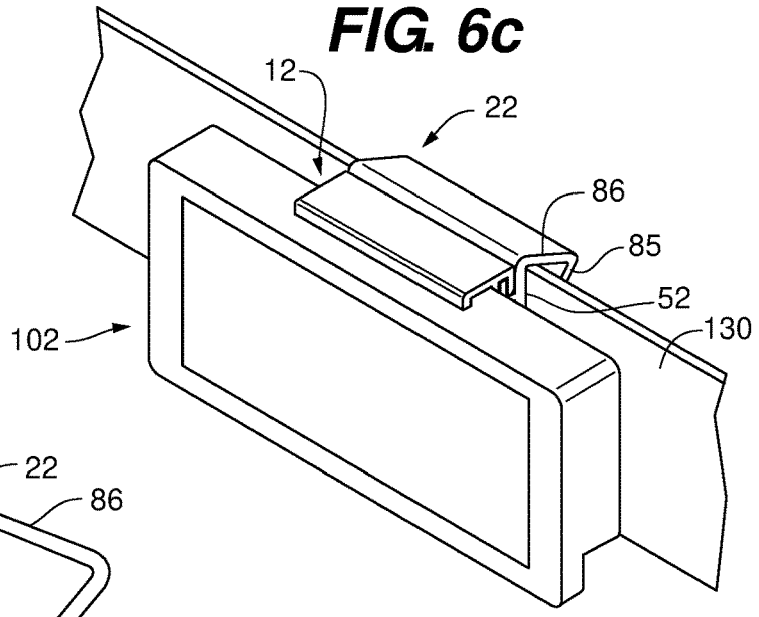
FIG. 6*c*. is an isometric view of the assembled and bar mounted first type of holder, fourth type of adapter, and first type of ESL shown in FIG. 6*b*.
Figure 6B:
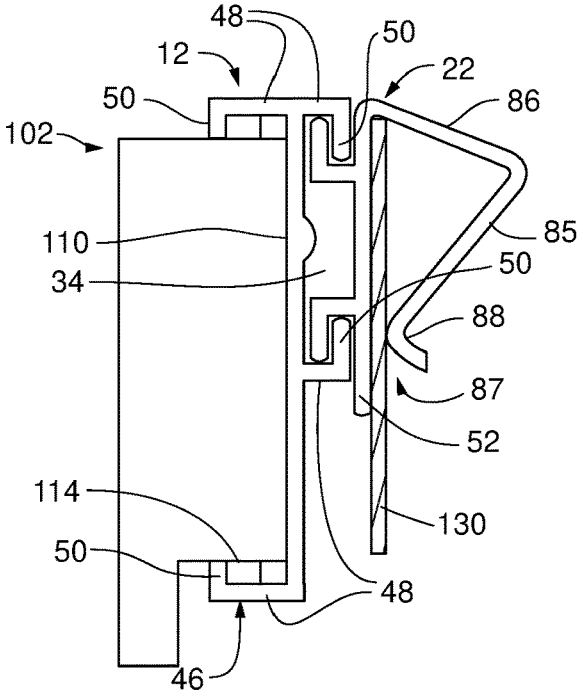
FIG. 6*b* is a side view of the first type of holder, fourth type of adapter, and first type of ESL as depicted in FIG. 6*a*, but shown fully assembled together and secured to a display bar.
Figure 7A:
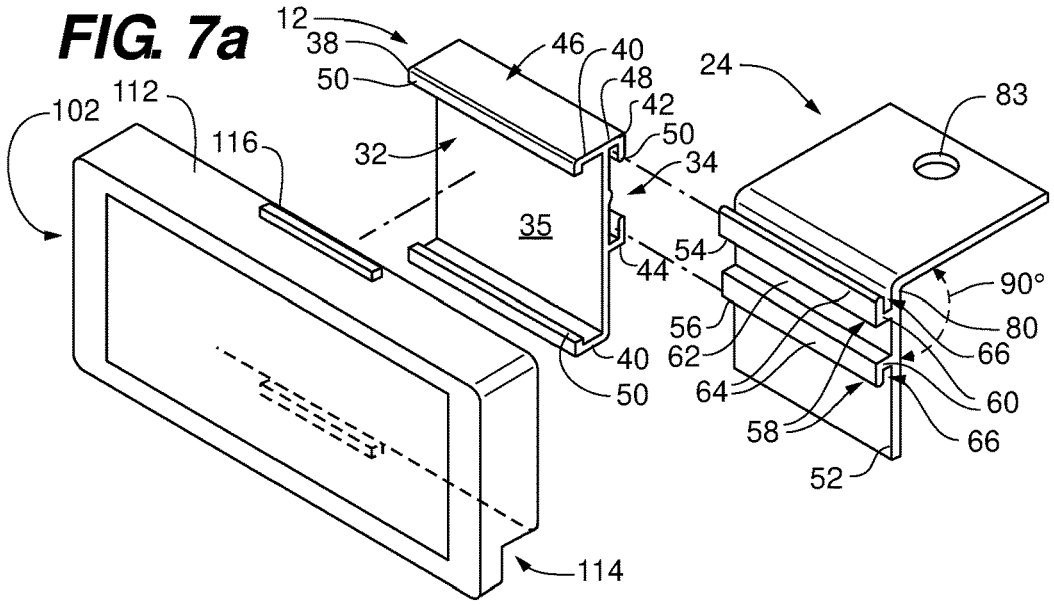
FIG. 7*a* is a schematic representation of the first type of holder and a fifth type of adapter as shown in FIG. 2, isometrically shown to depict their manner of engagement with one another and with a first type of ESL.
Figure 7B:
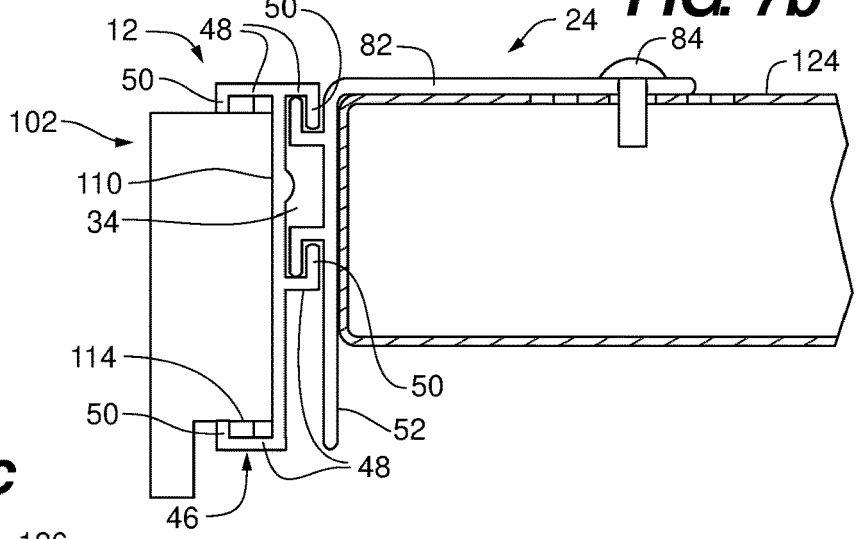
FIG. 7*b* is a side view of the first type of holder, fifth type of adapter, and first type of ESL as depicted in FIG. 7*a*, but shown fully assembled together and secured to a display surface.
Figure 7C:
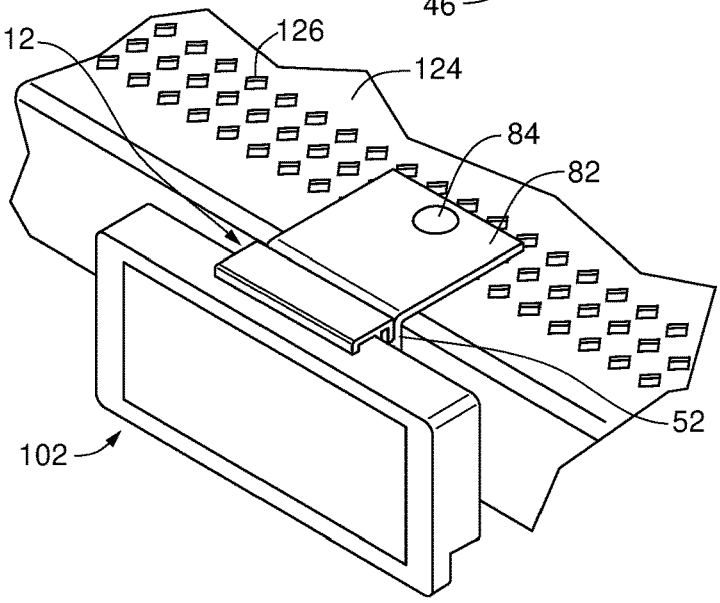
FIG. 7*c*. is an isometric view of the assembled and surface mounted first type of holder, first type of adapter, and first type of ESL shown in FIG. 7*b*.
Figure 8A:
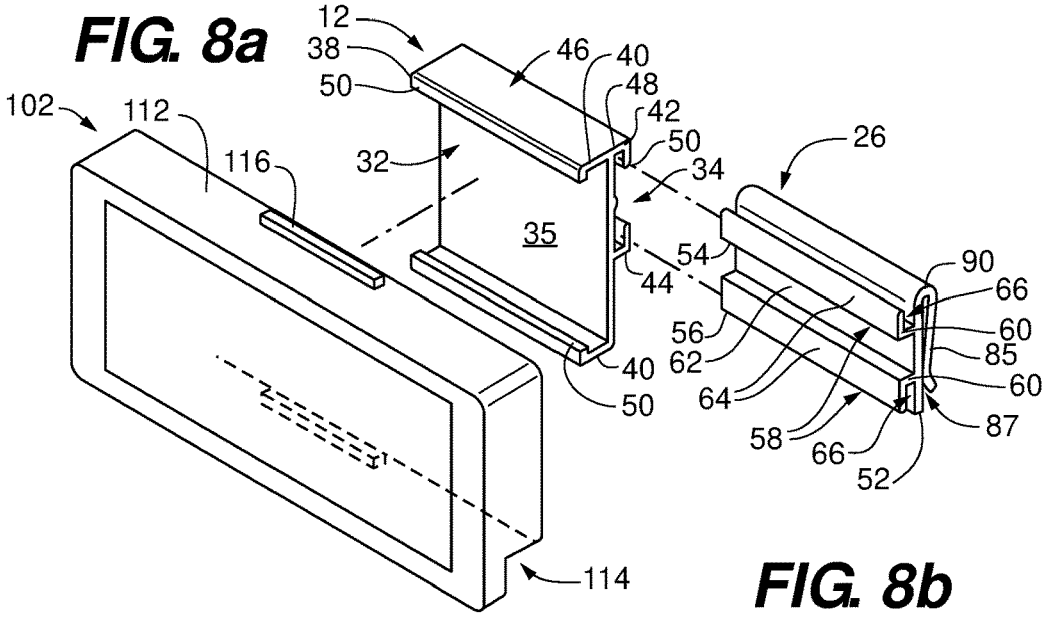
FIG. 8*a* is a schematic representation of the first type of holder and a sixth type of adapter as shown in FIG. 2, isometrically shown to depict their manner of engagement with one another and with a first type of ESL.
Figure 8B:
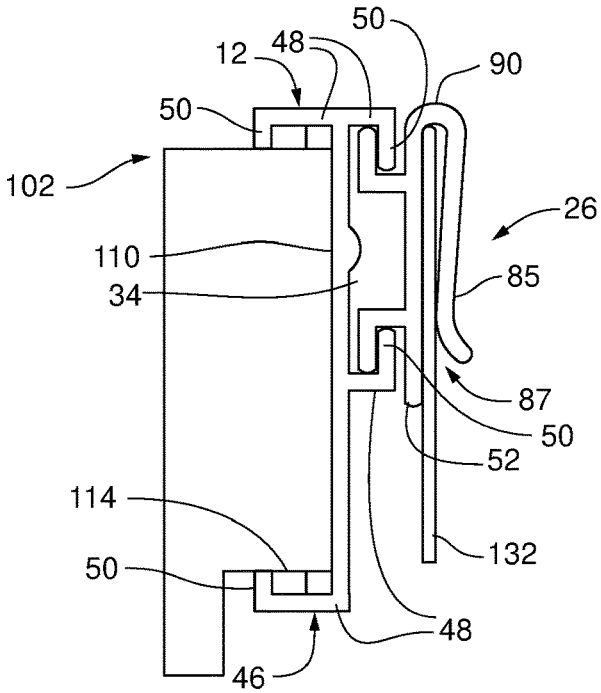
FIG. 8*b* is a side view of the first type of holder, sixth type of adapter, and first type of ESL as depicted in FIG. 8*a*, but shown fully assembled together and secured to a display bar.
Figure 8C:
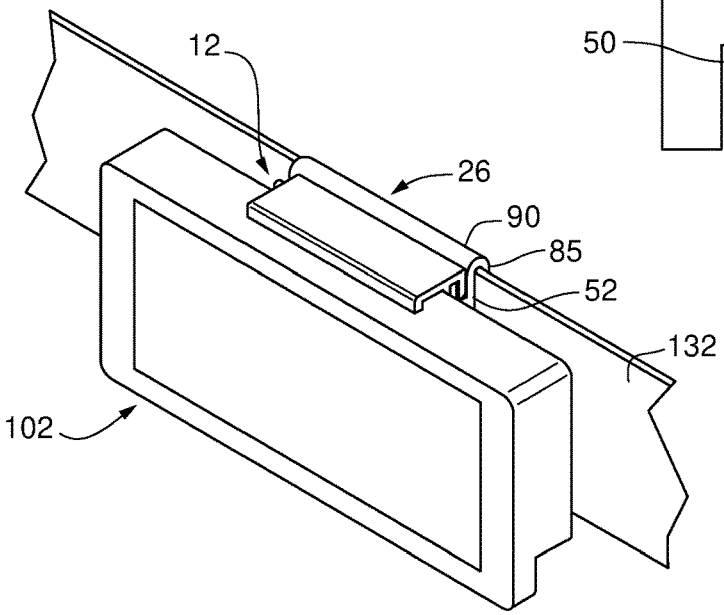
FIG. 8*c*. is an isometric view of the assembled and bar mounted first type of holder, sixth type of adapter, and first type of ESL shown in FIG. 8*b*.

Before returning to the structure and functionality of the rear facing C-channel 34, it is first necessary to describe the holder engagement features of the adapters 16, 18, 20, 22, 24, 26, and 28. As may be seen in the various figures, adapters 16, 18, 20, 22, 24, 26, and 28 have various shapes and sizes, but common to each is a front adapter panel 52 which has an upper holder clasping member 54 and a lower holder clasping member 56 extending therefrom. Exemplary front adapter panel 52 having all the features common to all adapters is shown in FIG. 2 and FIG. 3*a*.

The upper and lower holder clasping members 54 and 56 are in the form of an L-shaped adapter arm 58 that are of a common geometry and spacing on every adapter 16, 18, 20, 22, 24, 26, and 28. The L-shaped adapter arm 58 is comprised of an upper arm 60, which perpendicularly projects from the face 62 of the front adapter panel 52, and a lower arm 64, which perpendicularly projects from the end of the upper arm 60.

Each of the upper and lower holder clasping members 54 and 56 form a U-shaped receiving channel 66, whereby one side of the "U" is defined by the front adapter panel 52, the other side by the lower arm 64, and the bottom of the "U" defined by the upper arm 60.

Returning now to the rear facing C-channel 34 of the first holder 12. As may be seen in the various embodiments shown in FIGS. 3*a*-9*d*, engagement of the first holder 12 to any of the adapters 16, 18, 20, 22, 24, 26, and 28 is accomplished by sliding engagement of the upper adapter clasping member 42 and a lower adapter clasping member 44 of the first holder 12 into the respective U-shaped channels 66, defined by the respective upper holder clasping member 54 and lower holder clasping member and 56. Alternatively, this engagement may be described as having the upper holder clasping member 54 and lower holder clasping member and 56 of an adapter 16, 18, 20, 22, 24, 26, and 28 being slid into the confines of the rear facing C-channel 34 of the first holder 12.

The various arm components of the upper adapter clasping member 42 and lower adapter clasping member 44 of the C-channel 34, are of a uniform and complementary size, shape, and spacing relative to those of the upper holder clasping member 54 and lower holder clasping member and 56, so as to ensure that any and all types of adapters 16, 18, 20, 22, 24, 26, and 28 may be slidingly and interchangeable engaged to the first holder 12 as illustrated in the various FIGS. 3*a*-9*d*.

Though there are distinct structural differences between the first holder 12 and second holder 14 it should be understood that the structures and mechanisms of engagement that allow the first holder 12 to be able to engage with any of the various adapters 16, 18, 20, 22, 24, 26, and 28 are also common with the second type of holder 14, as illustrated in FIGS. 10-17*b*.

Turning now to the second holder 14, the second holder 14 is designed to support an ESL display 104. ESL displays 104 tend to be larger and heavier than ESL tags 102 and as such, a holder for supporting them has different characteristics. For example, rather than be provided with a front facing C-channel that grasps the external surfaces of the ESL in the manner of the first holder 12, the second holder 14 is provided with a flared engagement tab 31 that protrudes from the ESL side of the panel 36. ESL displays 104 configured for use with the second holder 14 will have a correspondingly shaped channel or notch (not visible in the figures) into which the flared engagement tab 31 may be received in order to secure the second holder 14 to the ESL display 104.

The second holder 14 may also include other ESL engagement mechanisms such as retaining posts 33. Retaining posts 33 are protrusions extending from the face 35 of the panel 36 and which engage openings or corresponding structures 118 present on the rear surface 110 of the ESL display 104 (see FIG. 11*b*).

In some embodiments the second housing 14 also includes a stop 37 that extends from the face 35 near the bottom of the panel 36, and on one or both sided of the flared engagement tab 31. The stop 37 ensures consistent positioning of the holder 14 relative to the ESL display 104.

In some embodiments the panel 36 of the second holder 14 is more vertically elongated than that of the first holder 12 (see FIG. 1 for comparison). This shape, along with appropriately engaged retaining posts 33, allows the second holder 14 to have sufficient surface area to support an ESL display 104 in either a vertical orientation or horizontal orientation, such as in the manner shown in FIG. 11*a*. In addition, the profile of the panel 36 of the second holder 14 is sufficient to allow room for two rear facing C-channels; an upper C-channel 39*a* and a lower C-channel 39*b*. Each of these C-channels have the same structure and characteristics as the rear facing C-channel 34 of the first holder 12, and either upper C-channel 39*a* or lower C-channel 39*b* may engage the U-shaped channels 66 of any of the adapters 16, 18, 20, 22, 24, 26, and 28 in the same manner as described above.

The second holder 14 is provided with upper C-channel 39*a* and a lower C-channel 39*b* so as to give the user more options for orienting the ESL display 104 relative to the adapters 16, 18, 20, 22, 24, 26, and 28, and the surface to which the adapter is secured.

As mentioned above, embodiments of the system 10, such as are shown in FIGS. 1-17*b*, are designed to afford the user the ability to mount and display ESLs in a wide range of diverse locations within a commercial setting, such as a retail store. While the system relies on the unique mechanisms of engagement for securing an ESL device to a holder 12 or 14, and the common mechanisms of engagement between the holders 12 and 14 and any of the variety of adapter types 16, 18, 20, 22, 24, 26, and 28, such as have been described above; the system also relies on each of the adapters being suitably configured for securement to at least one surface or structure that may be present in the commercial setting. To accomplish this, each of the adapters 16, 18, 20, 22, 24, 26, and 28, shown herein have a unique structure which allows them to be secured to or positioned upon a variety of surfaces.

Beginning with the first type of adapter 16, shown in detail in FIGS. 3*a*-3*c* and 11*a*-11*b*, the first adapter 16 is essentially a molded U-shaped clip comprised of the front adapter panel 52, a top panel 70 and a rear panel 72. These three panels form a U-shaped grasping channel 76 sized and shaped to correspond with the cross-sectional dimensions of a cross-bar or pole (merchandize bar) 120 that may be a component of retail shelving display 122. The first adapter 16, along with the first holder 12 and ESL tag 102 is clipped onto the cross-bar 120 in the manner shown in FIGS. 3*b*-3*c*. In the same manner, the first adapter 16, along with a second holder 14 and ESL display 104, may be clipped to the bar 120 in the manner shown in FIGS. 11*a*-11*b*.

The second type of adapter 18, shown in detail in FIGS. 4*a*-4*c* and 12*a*-12*b*, is essentially a molded V-shaped structure comprising the front adapter panel 52, and a surface engagement panel 82 that intersect to form an approximately 120-degree angle at their intersection 80. Note that the 120-degree angle is merely one angle that may be formed by the panels 52 and 82. In other embodiments the angle may be different. For example, the fifth type of adapter 24 shown in detail in FIGS. 7*a*-7*c* and 15*a*-15*b* is functionally similar to the second adapter 18, but the angle defined by the front adapter panel 52, and a surface engagement panel 82 is 90-degrees. Different angles are selected for different types of shelving fronts.

In some embodiments, the surface engagement panel 82 defines one or more through holes 83, through which a locking pin 84 may be passed. When used against a display surface such as a shelf 124 having base deck openings 126, the surface engagement panel 82 is positioned over shelf 124 and at least one hole 83 is aligned with at least one base deck opening 126; the locking pin 84 is then passed into both of the aligned hole 83 and base deck opening 126 to secure the second adapter 18 to the shelf 124. In this manner a second adapter 18, along with the first holder 12 and ESL tag 102 is secured to the shelf 124 in the manner shown in FIGS. 4*b*-4*c*. In the same manner, a second adapter 18, along with a second holder 14 and ESL display 104, may be secured to the shelf 124 in the manner shown in FIGS. 12*a*-12*b*.

In order to minimize the number of components needed, in some embodiments the locking pin 84 may be an integral part of the structure of the surface engagement panel 82. In such an embodiment, the surface engagement panel 82 lacks a hole(s) 83, and the pin 84 is a protrusion that is simply pushed into a base deck opening 126 when the surface engagement panel 82 is properly positioned over the shelf 124 to secure the second adapter 18 to the shelf 124.

The third type of adapter 20, shown in detail in FIGS. 5*a*-5*c* and 13*a*-13*b*, is a molded triangular shaped structure comprising the front adapter panel 52, a base panel 85, and a rear support panel 86. In some embodiments, the three panels 52, 85 and 86 are a single continuous structure, with no breaks or gaps between any of the panels. In the embodiments shown herein, the third adapter 20 defines a break 87 between the front adapter panel 52 and base panel 85. In some embodiments the break 87 between panels is between the base panel 85 and the rear support panel 86.

In use, the third adapter 20 is potentially a freestanding structure that provides a mechanism for displaying an ESL device at a desired uniform angle relative to any horizontal display surface. Given the desire to secure mount an ESL to a given surface, it is often more desirable to mechanically couple the third adapter 20 to a surface rather than merely setting the ESL equipped adapter upon one. In embodiments of the third adapter 20 having a break 87, structure of the adapter is such that the adjacent front adapter panel 52 and base panel 85 may be slightly pulled apart in order to allow the third adapter 20 to be slid over a shelf securement tab 128 that will pass through the break 87 and at least partially over the base panel 85. In this arrangement, such as is illustrated in FIGS. 5*b* and 5*c* (third adapter 20 equipped with a first housing 12 and an ESL tag 102) as well as in FIGS. 13*a* and 13*b* (third adapter 20 equipped with a second housing 4 and an ESL display 104) the base panel 85 is effectively sandwiched between the shelf securement tab 128 and the shelf 124, thereby coupling the third adapter to the shelf 124.

A fourth type of adapter 22 is shown in detail in FIGS. 6*a*-6*c* and FIGS. 14*a* and 14*b*. The fourth type of adapter 22 is essentially a clip for attaching the adapter to a vertical member such as shelving partition or display rail 130 in the manner shown in FIGS. 6*b*-6*c* and 14*b*. To accomplish this, the fourth type of adapter 22 is provided with a basic three-sided structure similar to that of the third adapter 20, with a break 87 provided between the front adapter panel 52 and base panel 85. In the case of the fourth type of adapter 22, the base panel 85 is provided with a curved lip 88 which acts as a guide for the sliding engagement of the adapter 22 onto the display rail 130. The fourth adapter 22 is shaped such that when the display rail passes through the break 87, the rail 130 is biased against the front adapter panel 52 and secured there against by the curved lip 88.

In the case of the fourth adapter 22 the width 89 of the rear support panel 86 reflects the width of the display rail 130 that the adapter 22 is capable of accepting past the break 87. In contrast, a sixth type of adapter 26 such as is shown in FIGS. 8*a*-8*c* and 16*a*-16*b*, is of a similar construction and use, to that of the to the fourth adapter 22, but it is designed for engagement to structures far thinner than the rail 130 discussed above. Here, in the case of the sixth adapter 26, the rear support panel 86 is nothing more than a transitional curve 90 that keeps the front adapter panel 52 and base panel 85 in close proximity and limits the extent to which the break 87 may be widened. The sixth adapter 26 is adapted for engagement directly on product packaging, and particularly thin display rails 132 of the type shown in FIGS. 8*b*-8*c* and 16*b*.

Figure 17A:
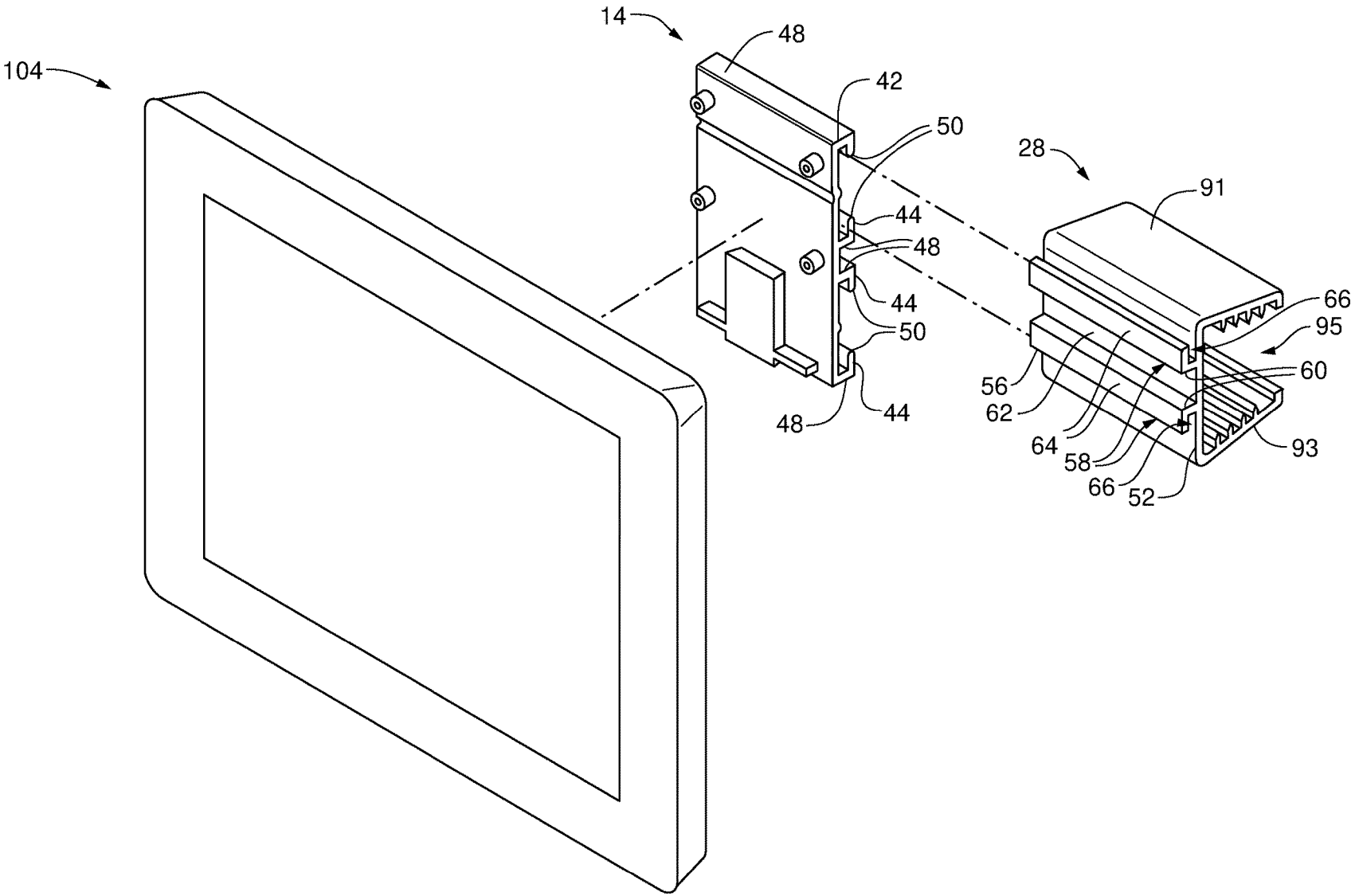
FIG. 17*a* is a schematic representation of the second type of holder and a seventh type of adapter as shown in FIG. 10, isometrically shown to depict their manner of engagement with one another and with a second type of ESL.
Figure 17B:
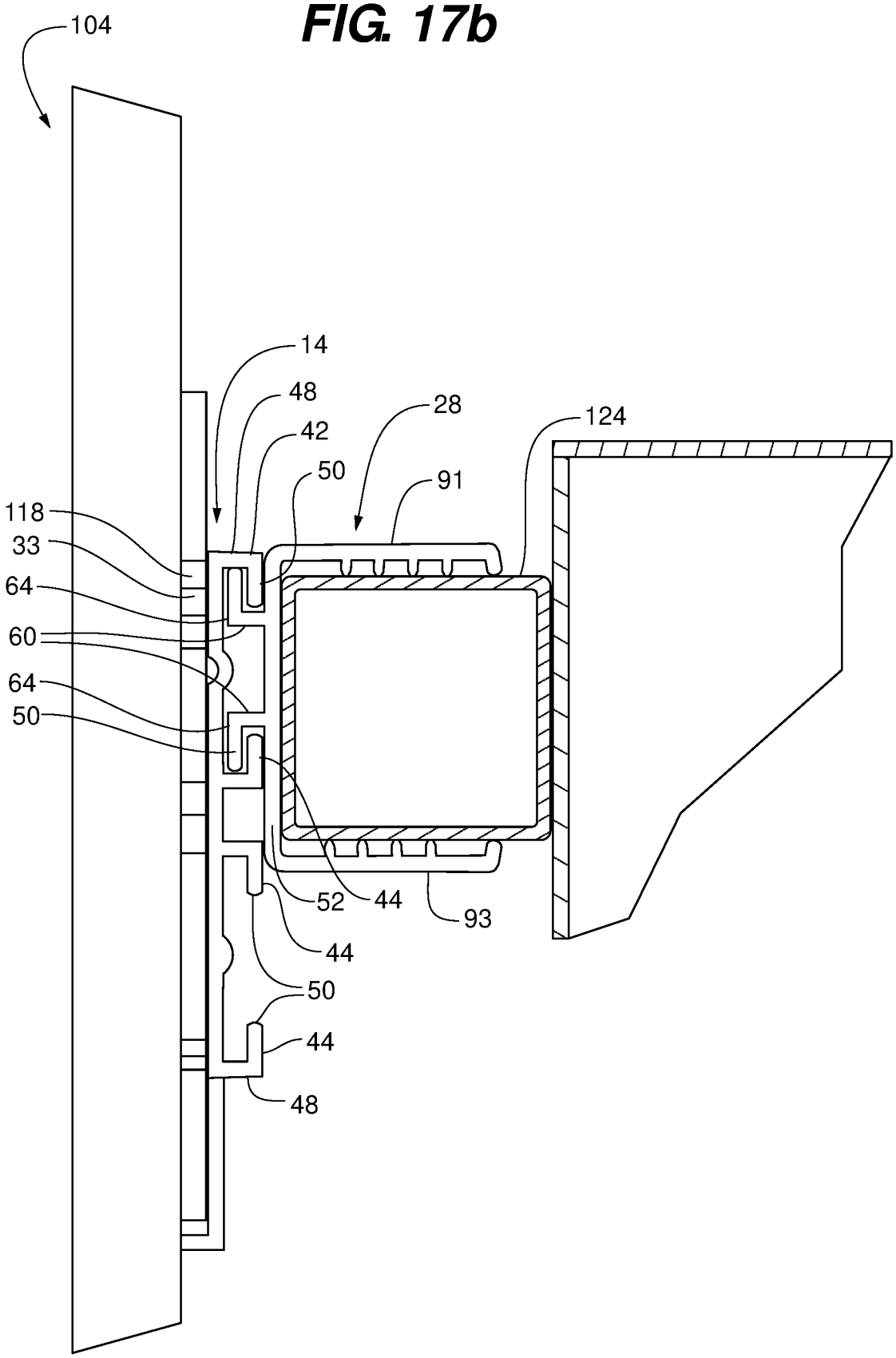
FIG. 17*b* is a side view of the second type of holder, seventh type of adapter, and second type of ESL as depicted in FIG. 17*a*, but shown fully assembled together and depicting fully engaged to a display bar.

A seventh adapter type 28 is shown in detail in FIGS. 9*a*-9*d* in association with a first holder 12 and an ESL tag 102, and in FIGS. 17*a*-17*b* in association with a second holder 14 and an ESL display 104. The seventh adapter is a U-shaped clip capable of engaging fairly large objects such as a shelf in the manner shown in FIGS. 9*b*-9*c* and 17*b*. The seventh adapter 28 includes the front adapter panel 52, a top gripping panel 91 that extends at an angle 92 from the top of the front adapter panel 52, and a bottom gripping panel 93 that extends at an angle 94 from the bottom of the front adapter panel 52 (angles 92 and 94 shown in FIG. 9*b*).

While angles 92 and 94 may be the same, in some embodiments they may be different. In the embodiment shown, the angles 92 and 94 are less than 90 degrees. The manner in which the panels 91 and 93 extend from the front adapter panel 52, provides the seventh adapter 28 with a tapered U-shaped gripping channel 95 defined by the panels 52, 91 and 93 (gripping channel shown in labeled in FIGS. 9*a*-9*b* and 17*a*).

Figure 9A:
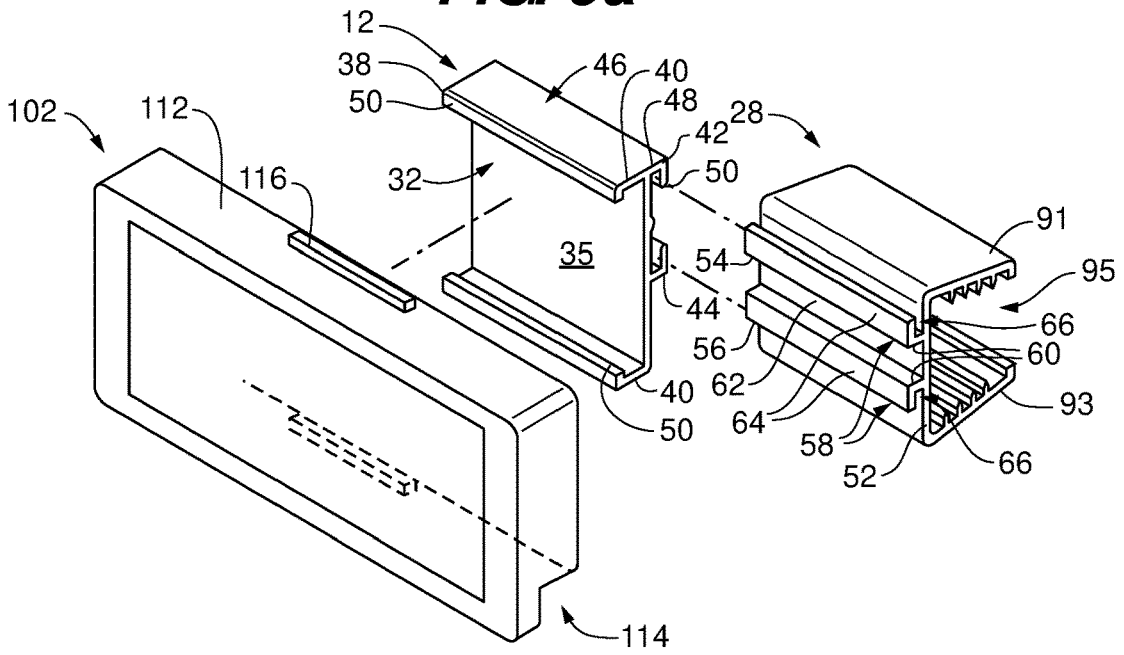
FIG. 9*a* is a schematic representation of the first type of holder and a seventh type of adapter as shown in FIG. 2, isometrically shown to depict their manner of engagement with one another and with a first type of ESL.
Figure 9D:
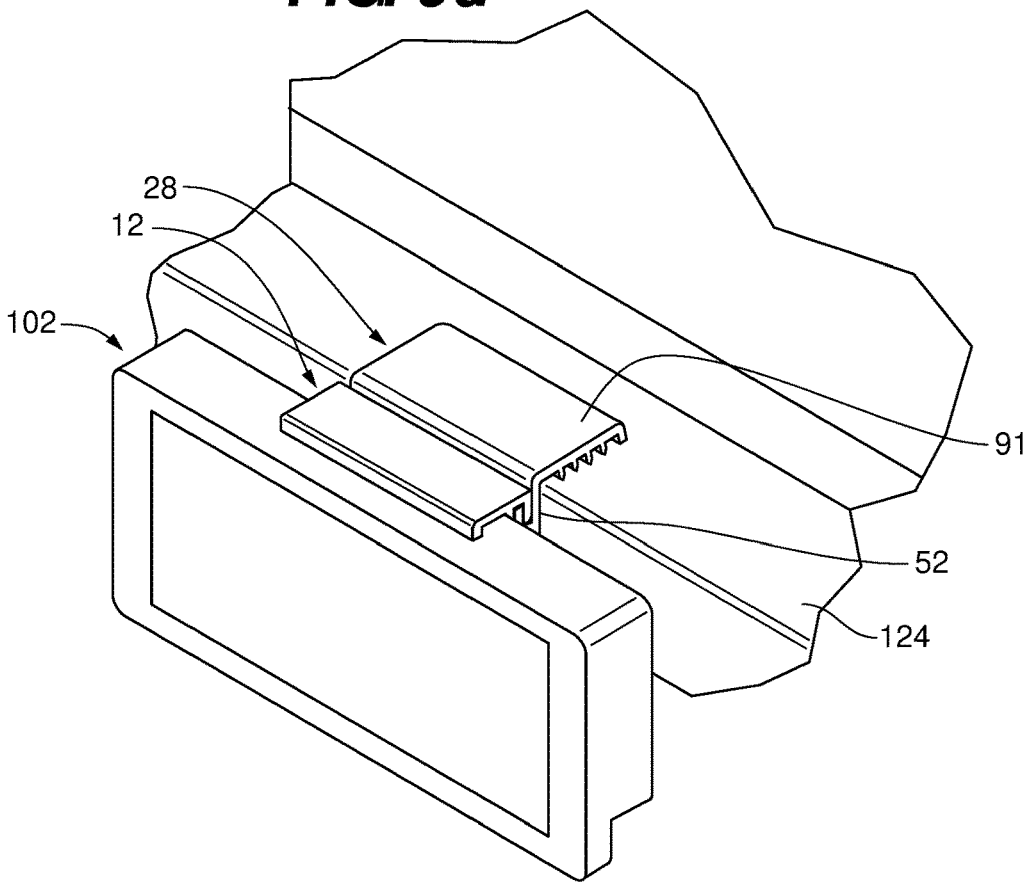
FIG. 9*d*. is an isometric view of the assembled and bar mounted first type of holder, seventh type of adapter, and first type of ESL shown in FIG. 9*c*.
Figure 9B:
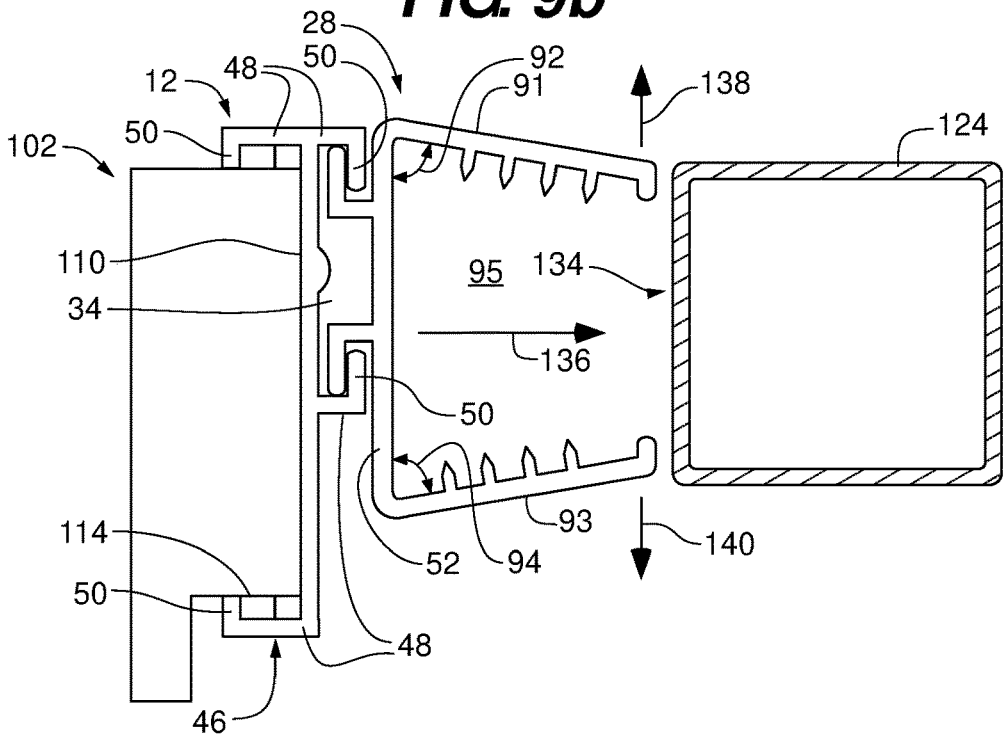
FIG. 9*b* is a side view of the first type of holder, seventh type of adapter, and first type of ESL as depicted in FIG. 9*a*, but shown fully assembled together and depicting the manner in which the seventh type of adapter may be manipulated to engaged a retaining surface.
Figure 9C:
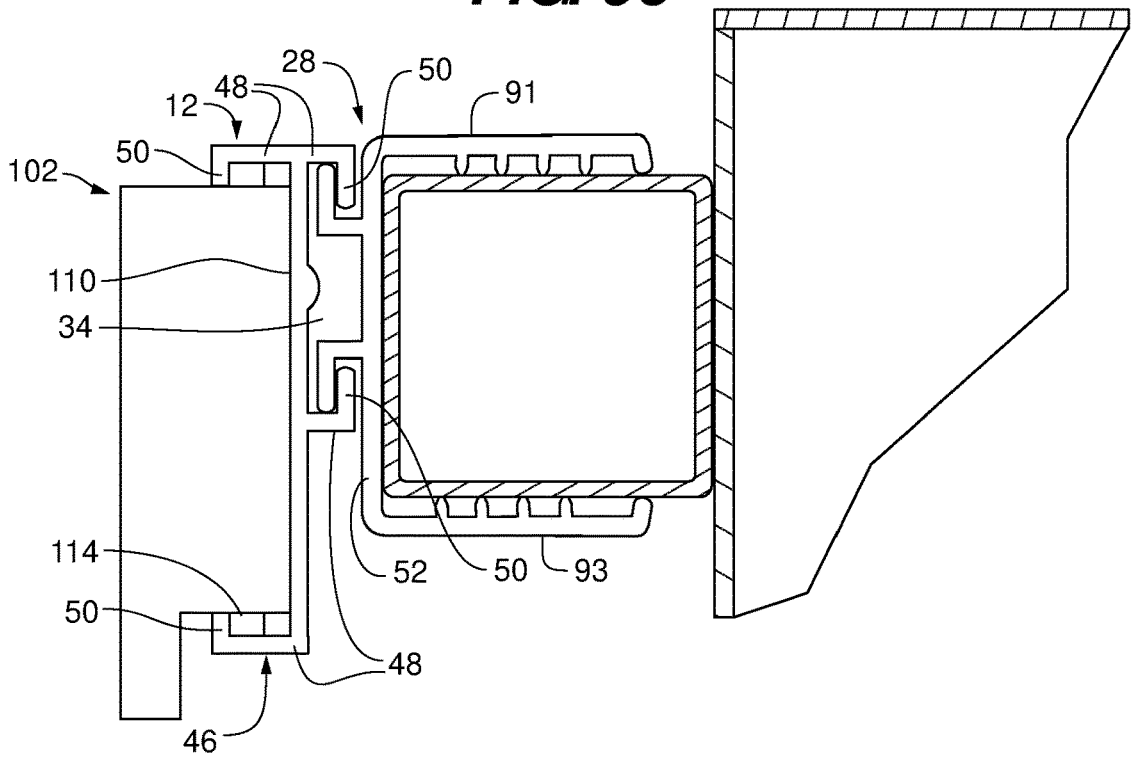
FIG. 9*c*. is a side view of the assembled first type of holder, seventh type of adapter, and first type of ESL as depicted in FIG. 9*b* but with the seventh type of adapter shown fully engaged to a display bar.
Figure 10:
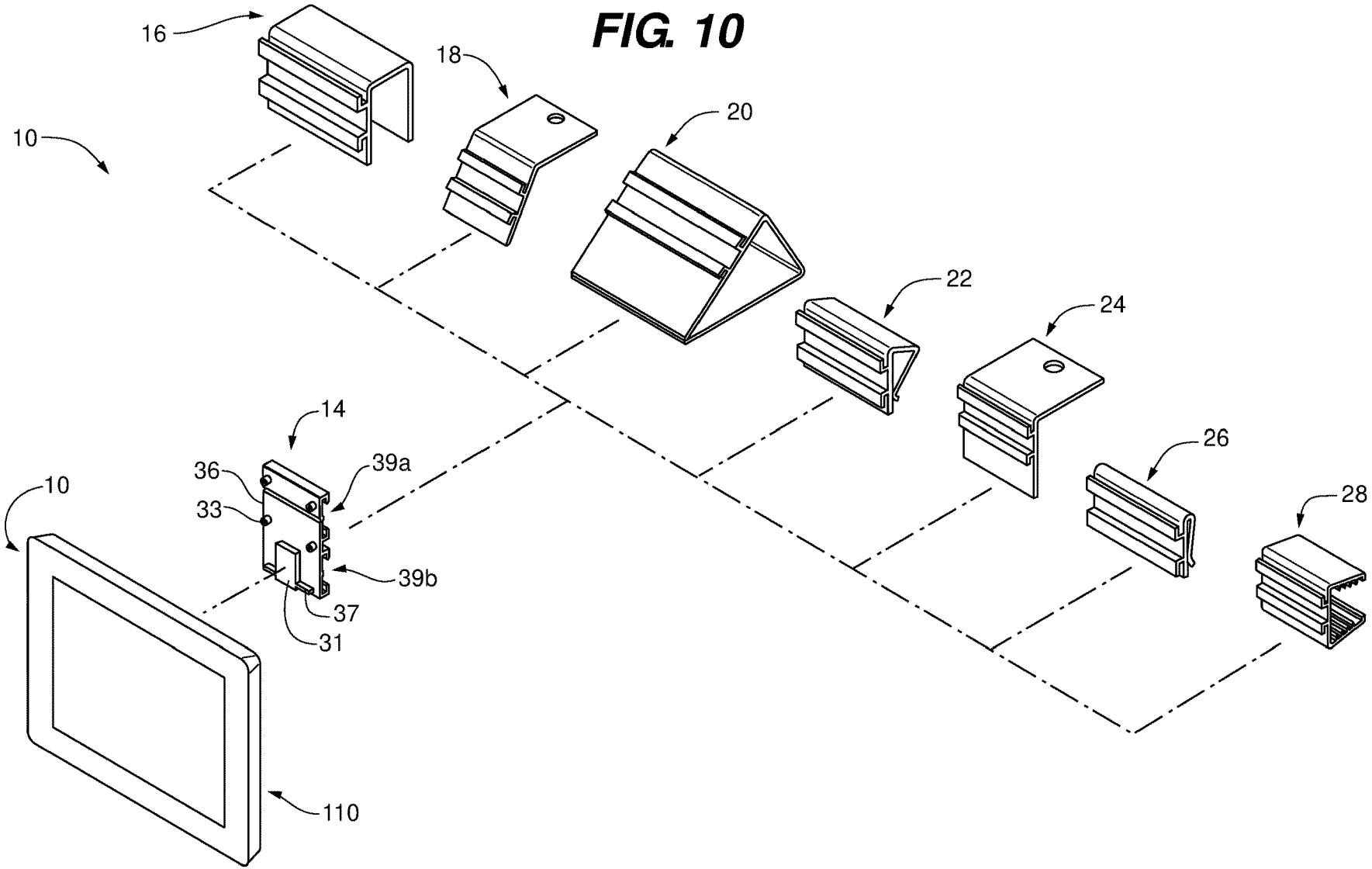
FIG. 10 is a schematic representation of an embodiment of the system having only the second type of holder, but all seven types of adapters shown in FIG. 1 isometrically shown.
Figure 11A:
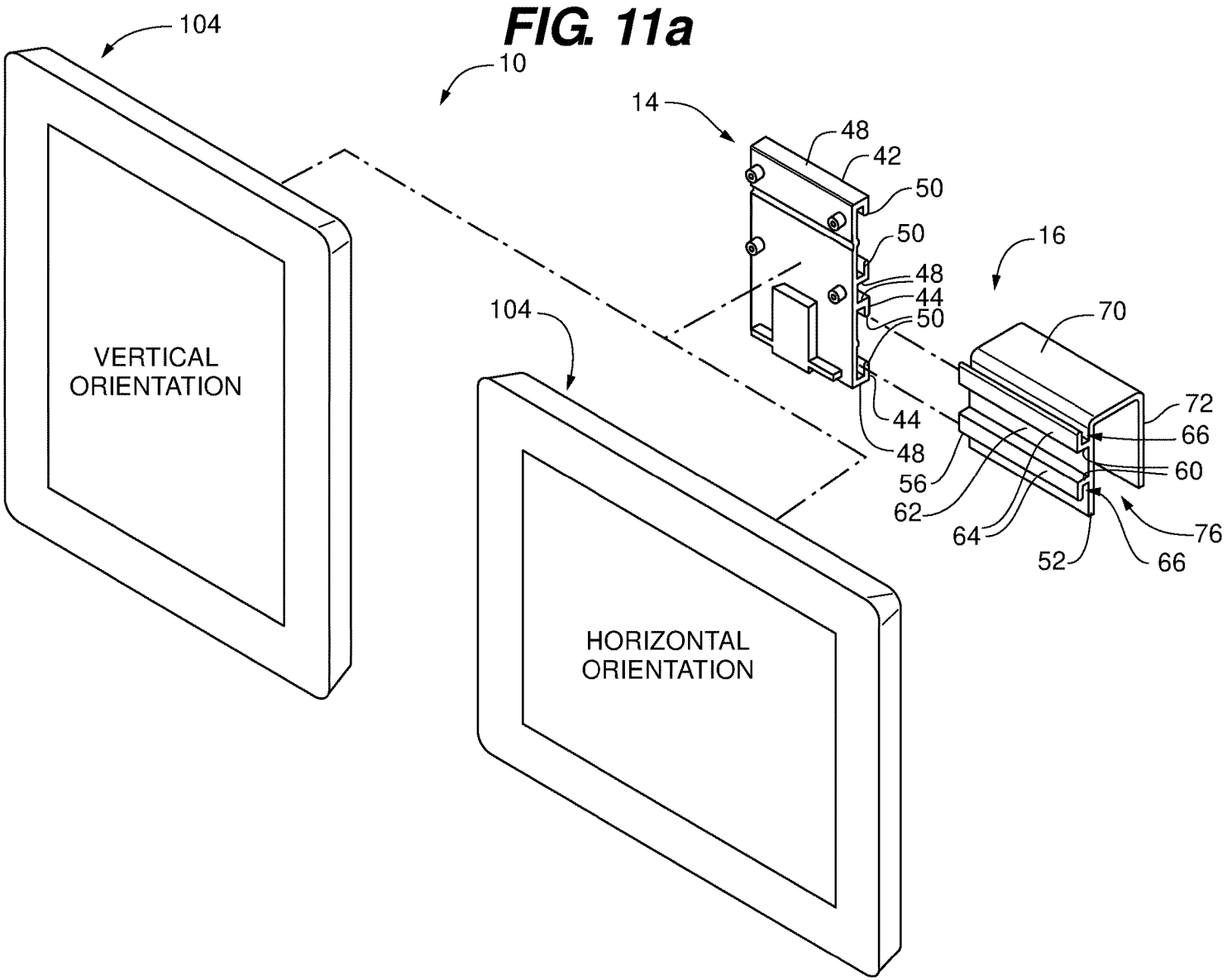
FIG. 11*a* is a schematic representation of the second type of holder and a first type of adapter as shown in FIG. 10, isometrically shown to depict their manner of engagement with one another and with a second type of ESL.
Figure 11B:
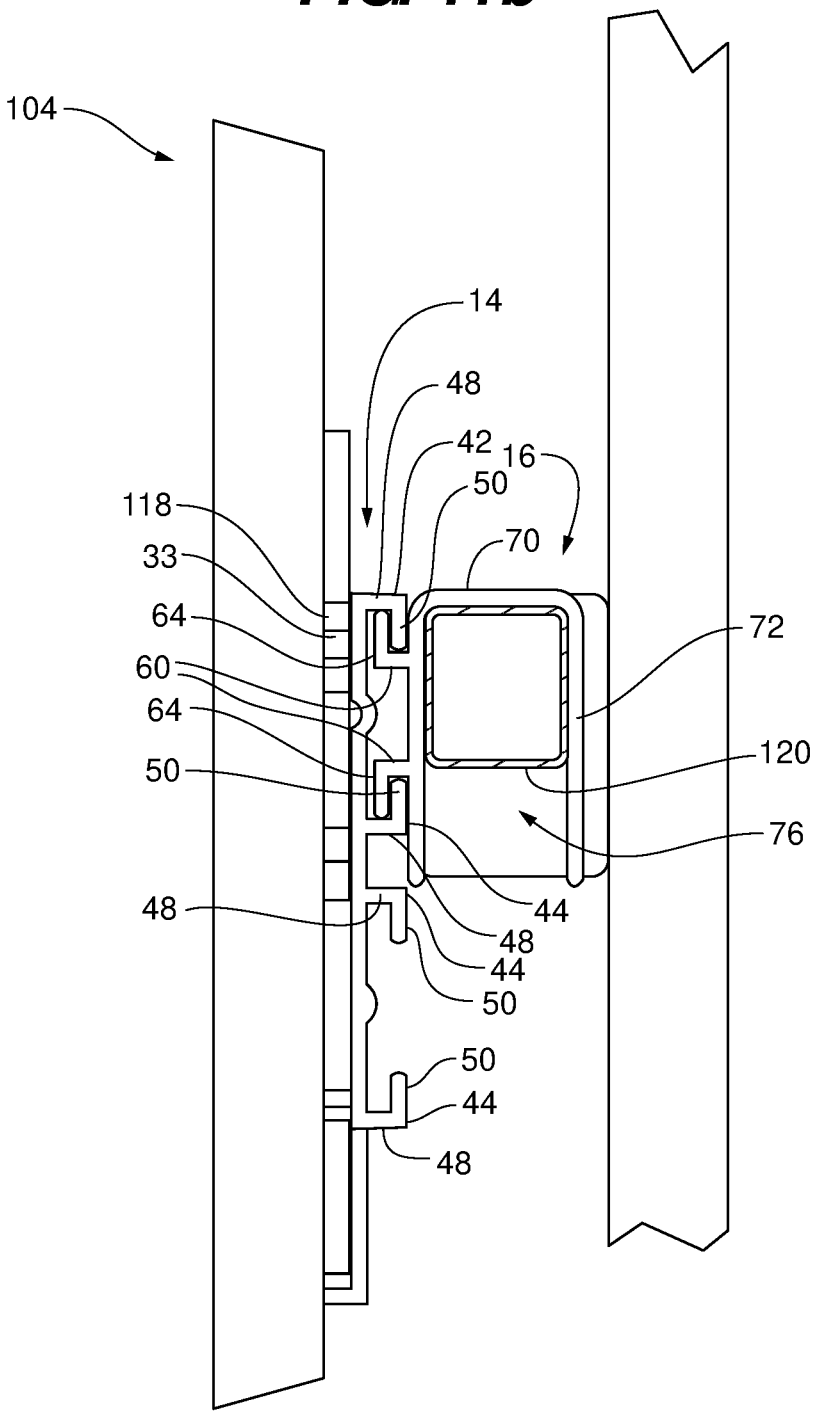
FIG. 11*b* is a side view of the second type of holder, second type of adapter, and second type of ESL as depicted in FIG. 11*a*, but shown fully assembled together and secured to a display bar.
Figure 12A:
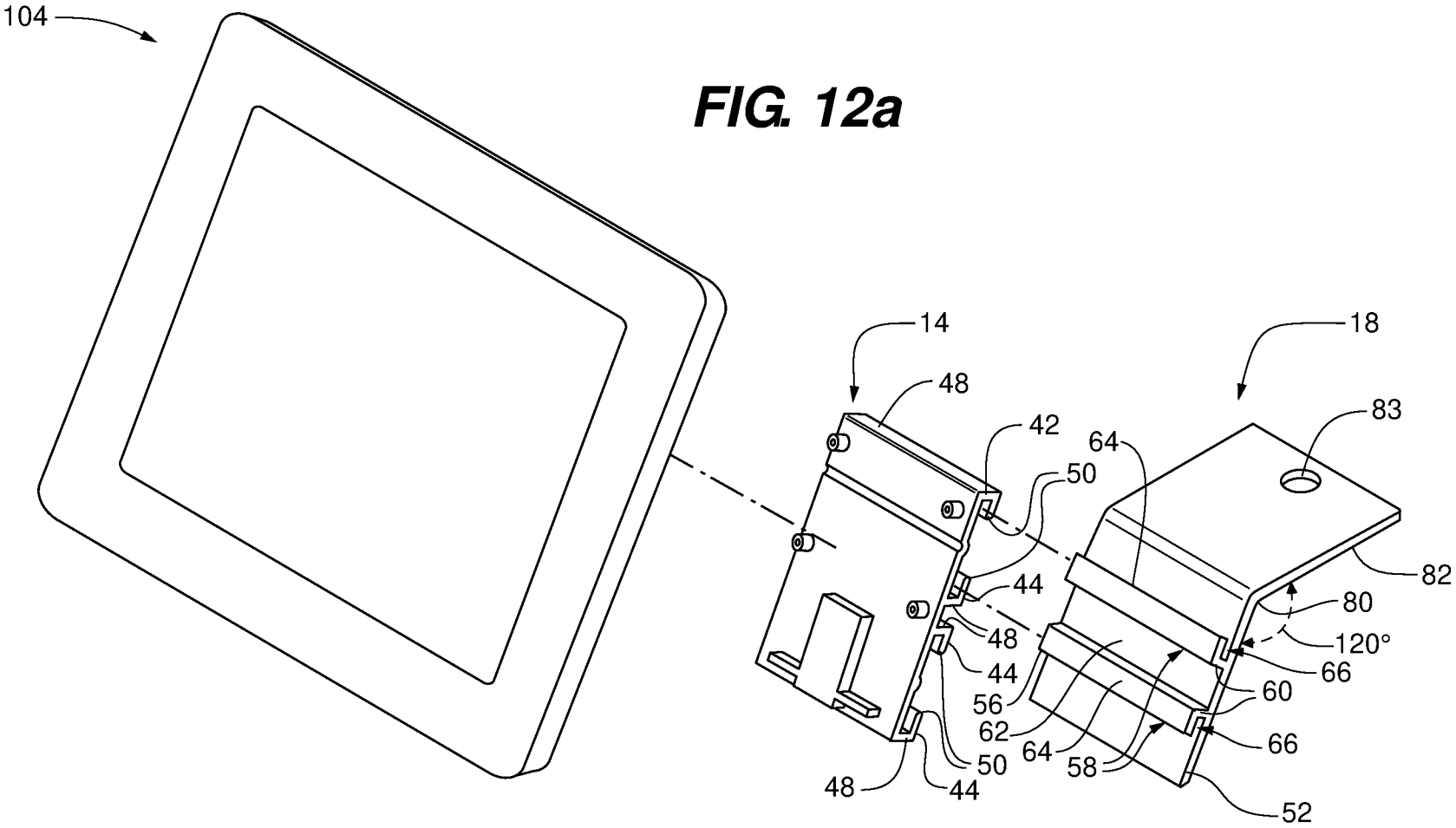
FIG. 12*a* is a schematic representation of the second type of holder and a second type of adapter as shown in FIG. 10, isometrically shown to depict their manner of engagement with one another and with the second type of ESL.
Figure 12B:
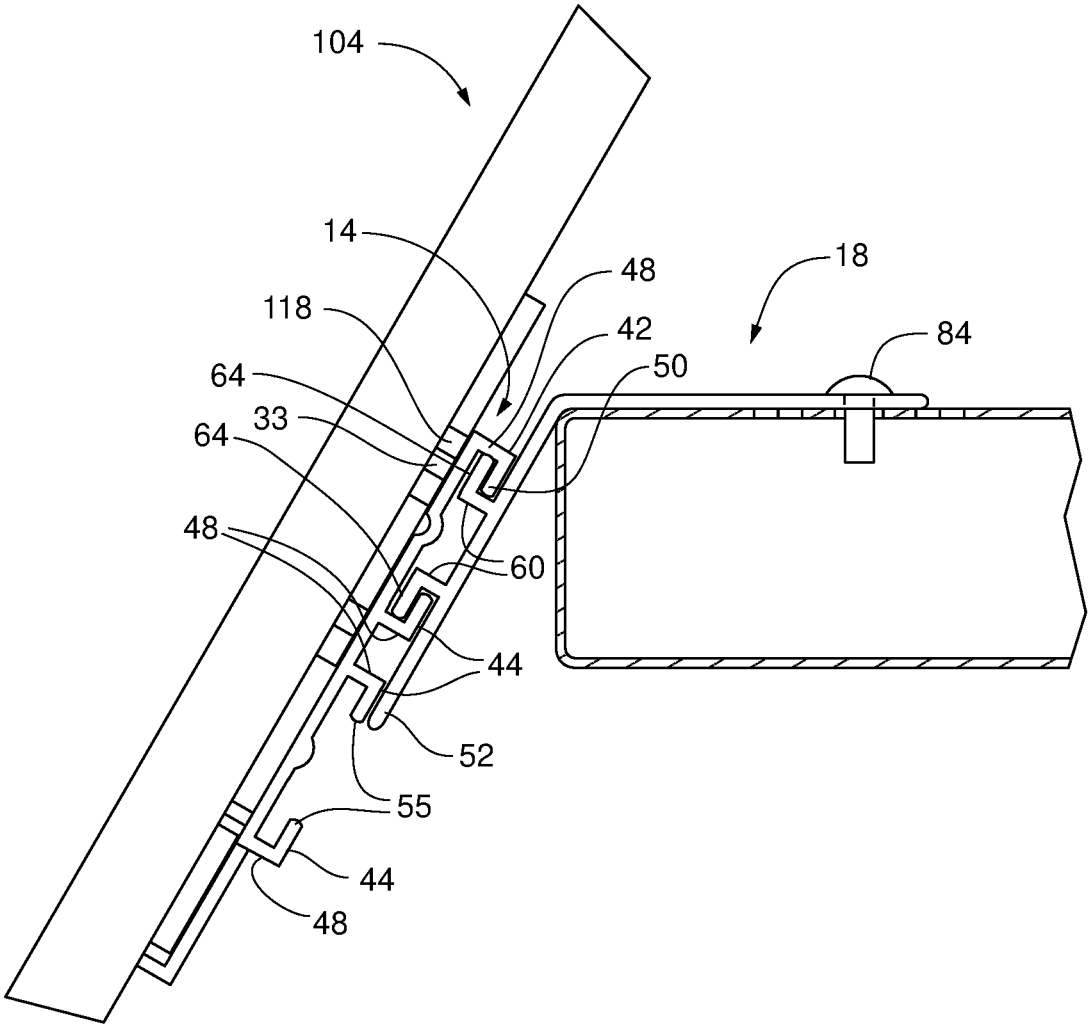
FIG. 12*b* is a side view of the second type of holder, second type of adapter, and second type of ESL as depicted in FIG. 12*a*, but shown fully assembled together and secured to a display surface.
Figure 13A:
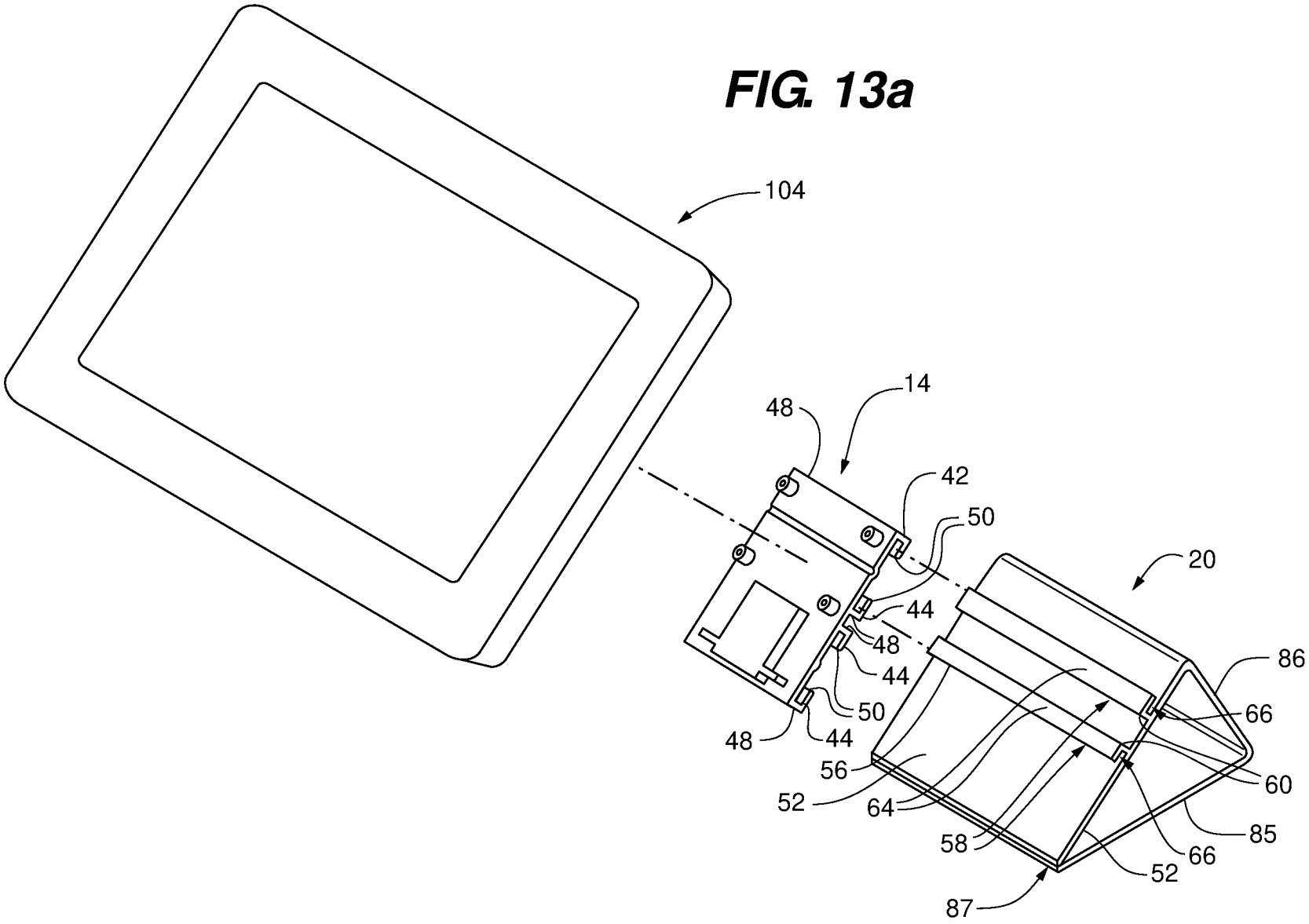
FIG. 13*a* is a schematic representation of the second type of holder and a third type of adapter as shown in FIG. 10, isometrically shown to depict their manner of engagement with one another and with the first type of ESL.
Figure 13B:
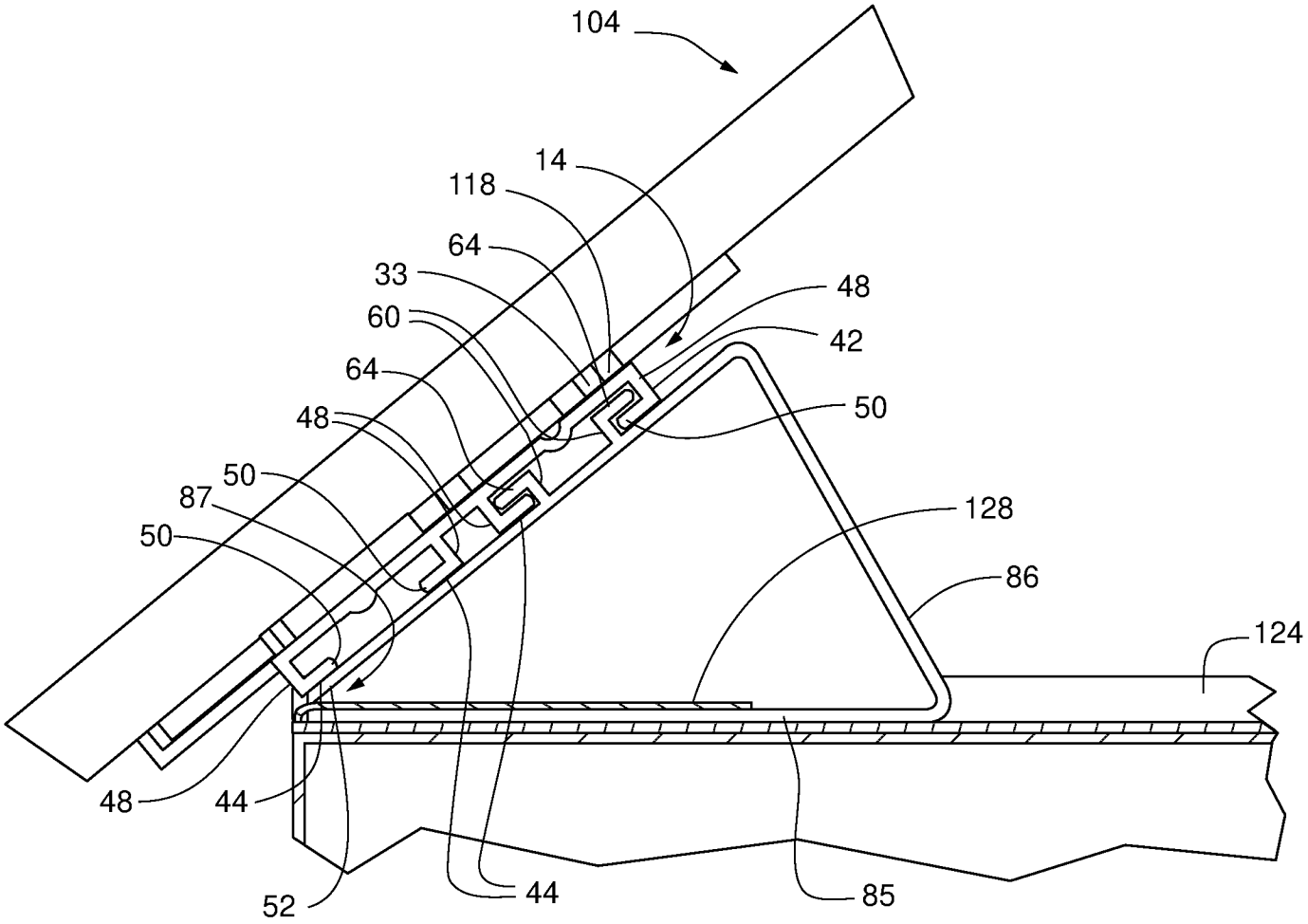
FIG. 13*b* is a side view of the second type of holder, third type of adapter, and second type of ESL as depicted in FIG. 13*a*, but shown fully assembled together and positioned upon a display surface.
Figure 14A:
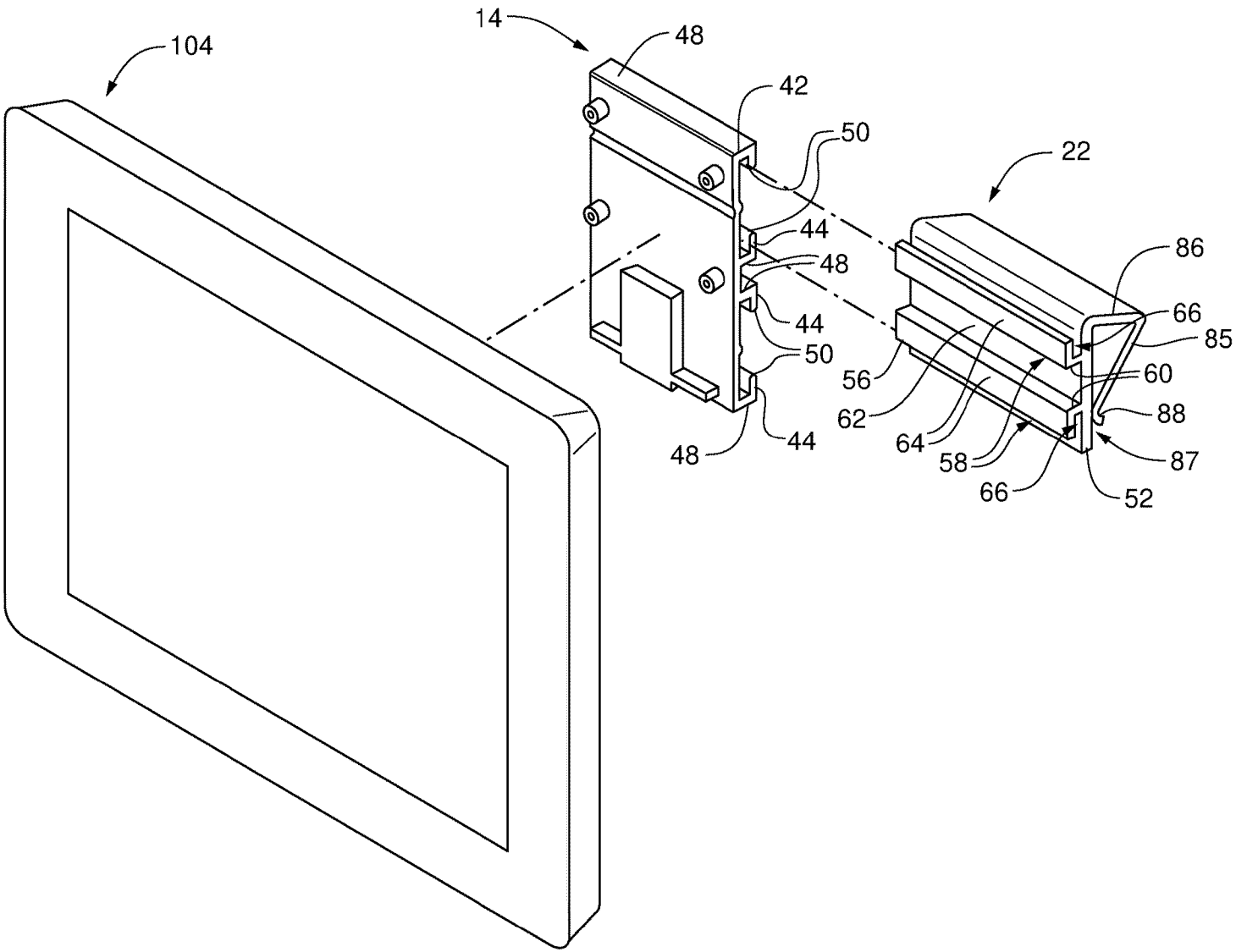
FIG. 14*a* is a schematic representation of the second type of holder and a fourth type of adapter as shown in FIG. 10, isometrically shown to depict their manner of engagement with one another and with a second type of ESL.
Figure 14B:
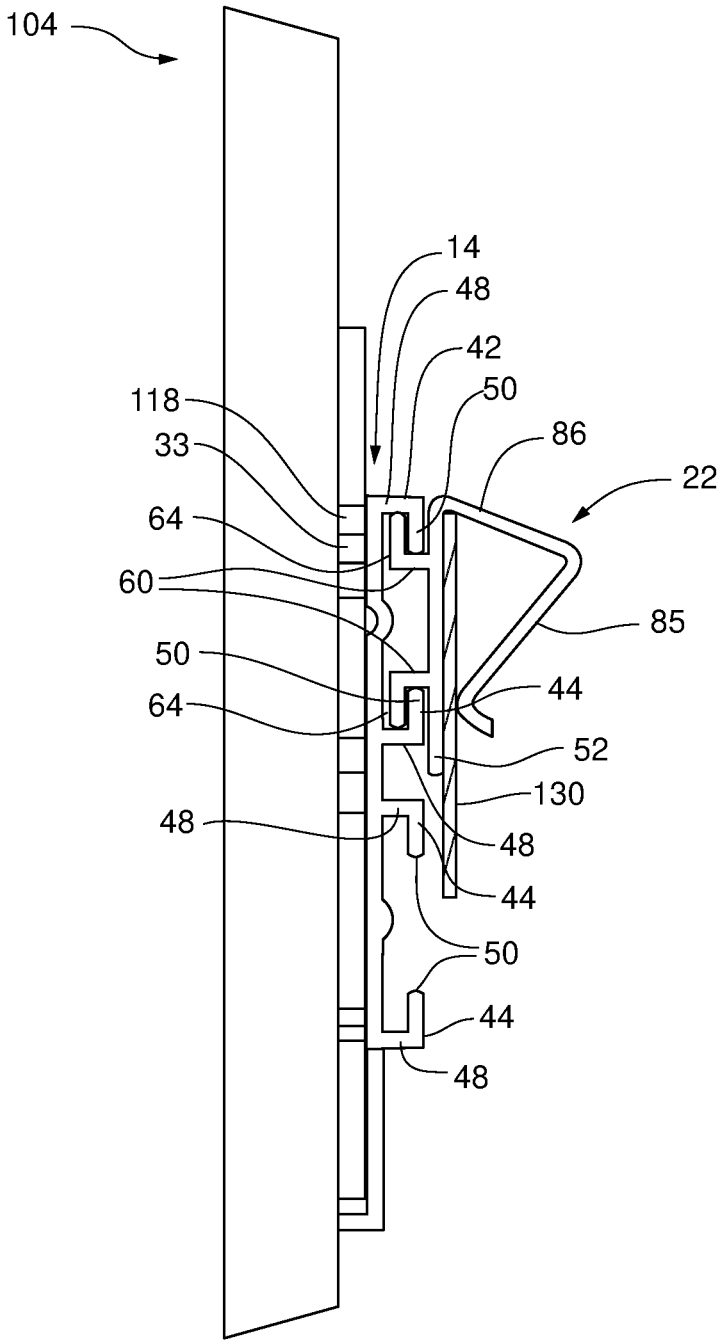
FIG. 14*b* is a side view of the second type of holder, fourth type of adapter, and second type of ESL as depicted in FIG. 6*a*, but shown fully assembled together and secured to a display bar.
Figure 15A:
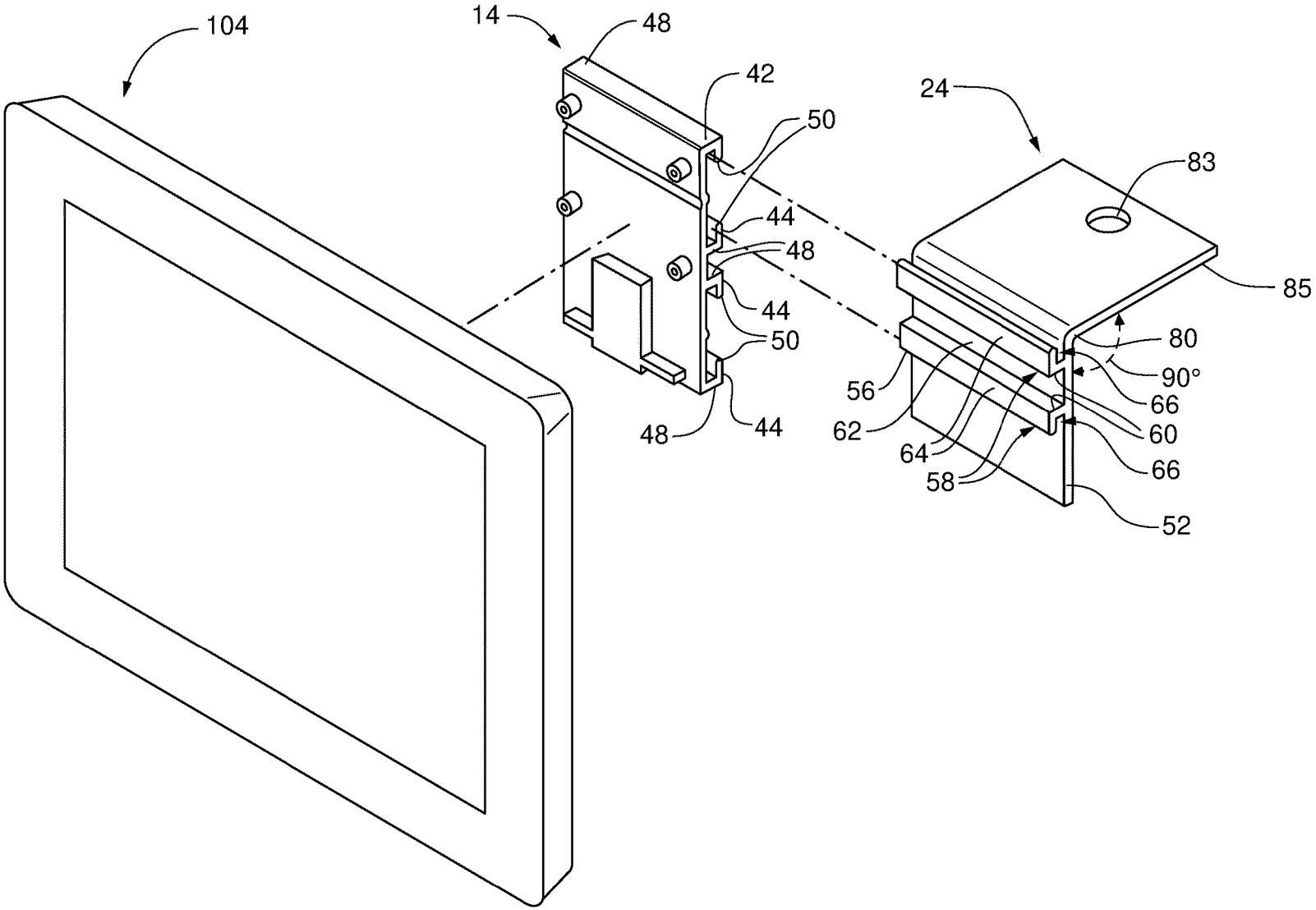
FIG. 15*a* is a schematic representation of the second type of holder and a fifth type of adapter as shown in FIG. 10, isometrically shown to depict their manner of engagement with one another and with a second type of ESL.
Figure 15B:
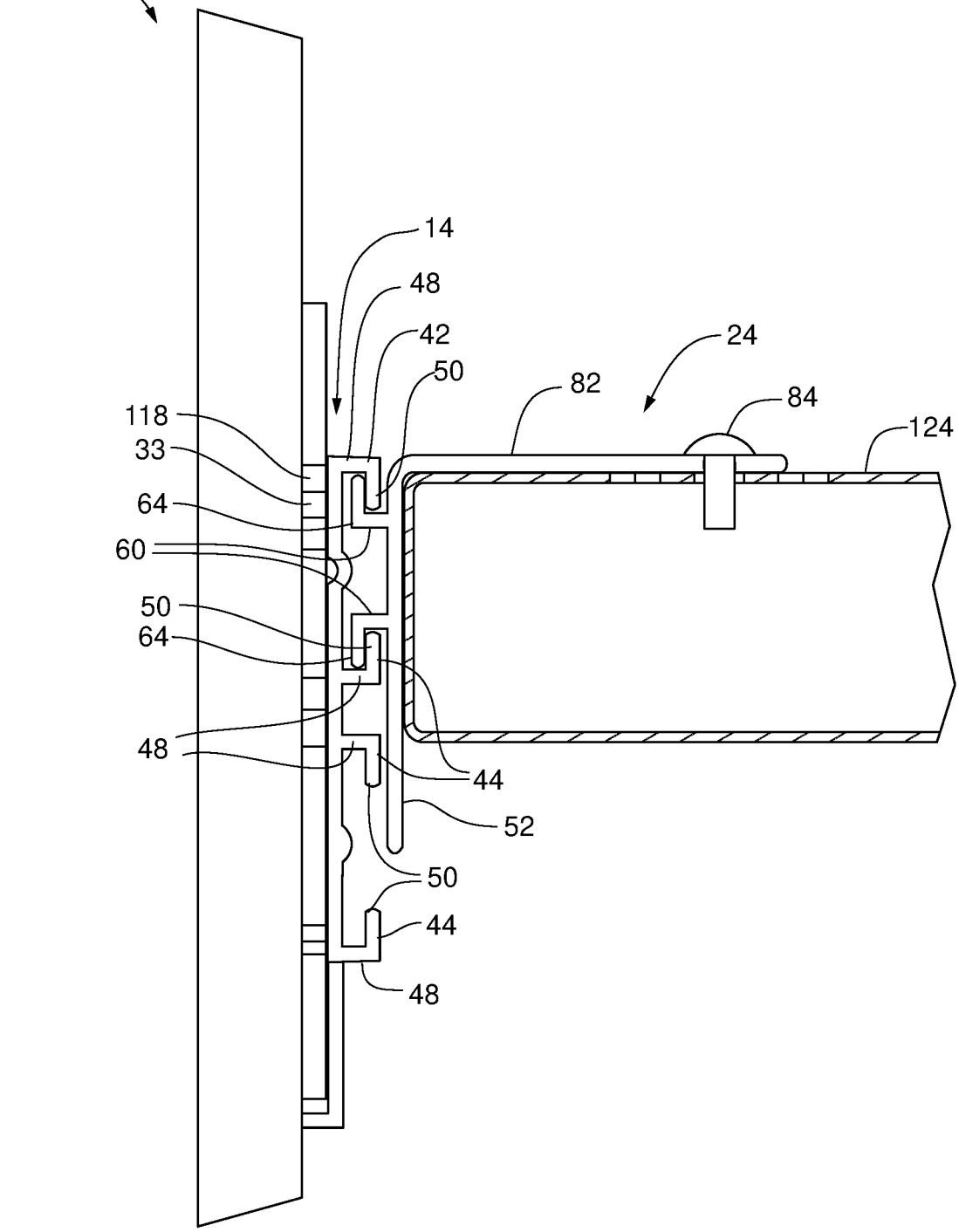
FIG. 15*b* is a side view of the second type of holder, fifth type of adapter, and second type of ESL as depicted in FIG. 15*a*, but shown fully assembled together and secured to a display surface.
Figure 16A:
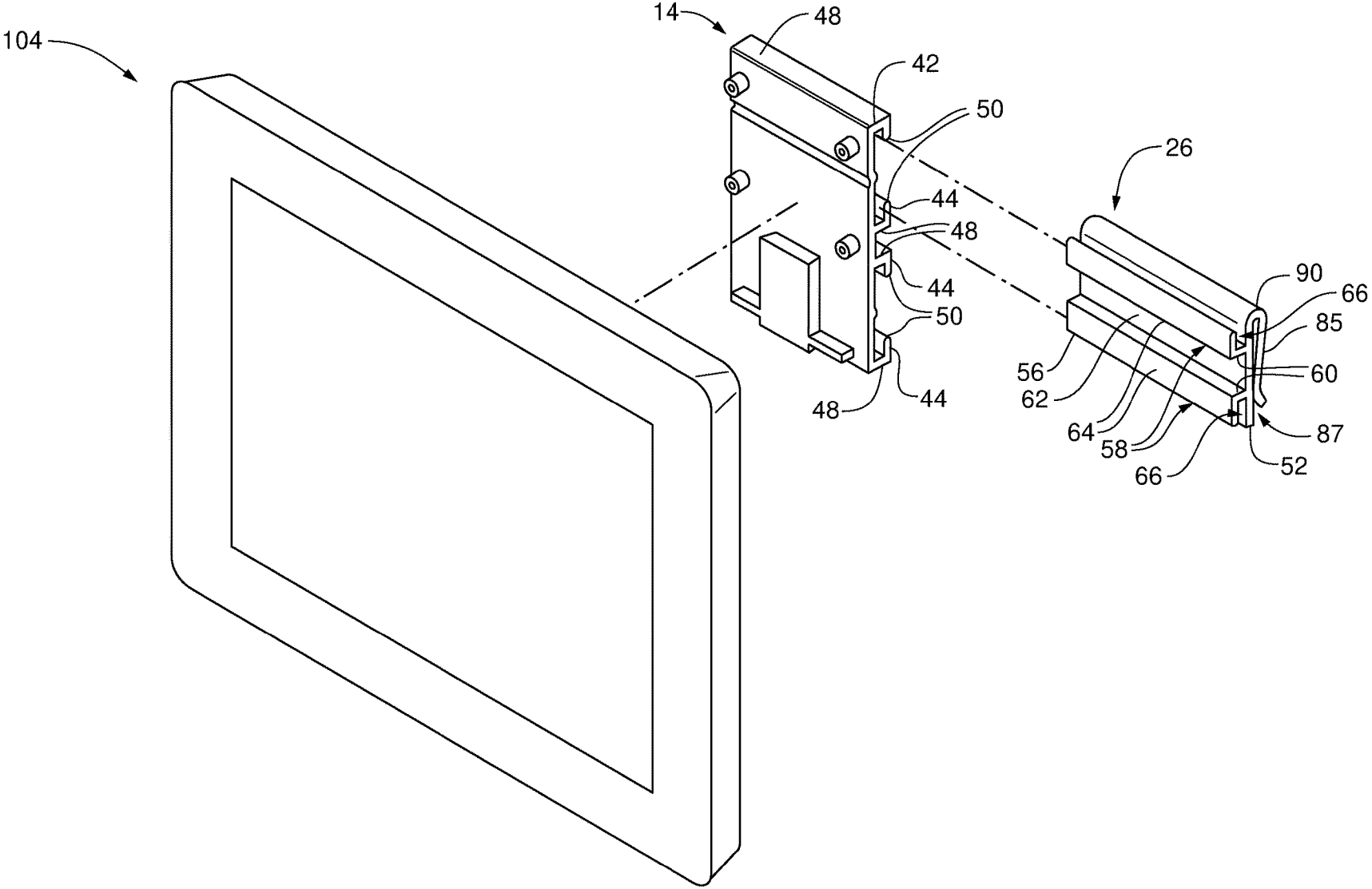
FIG. 16*a* is a schematic representation of the second type of holder and a sixth type of adapter as shown in FIG. 10, isometrically shown to depict their manner of engagement with one another and with a second type of ESL.
Figure 16B:
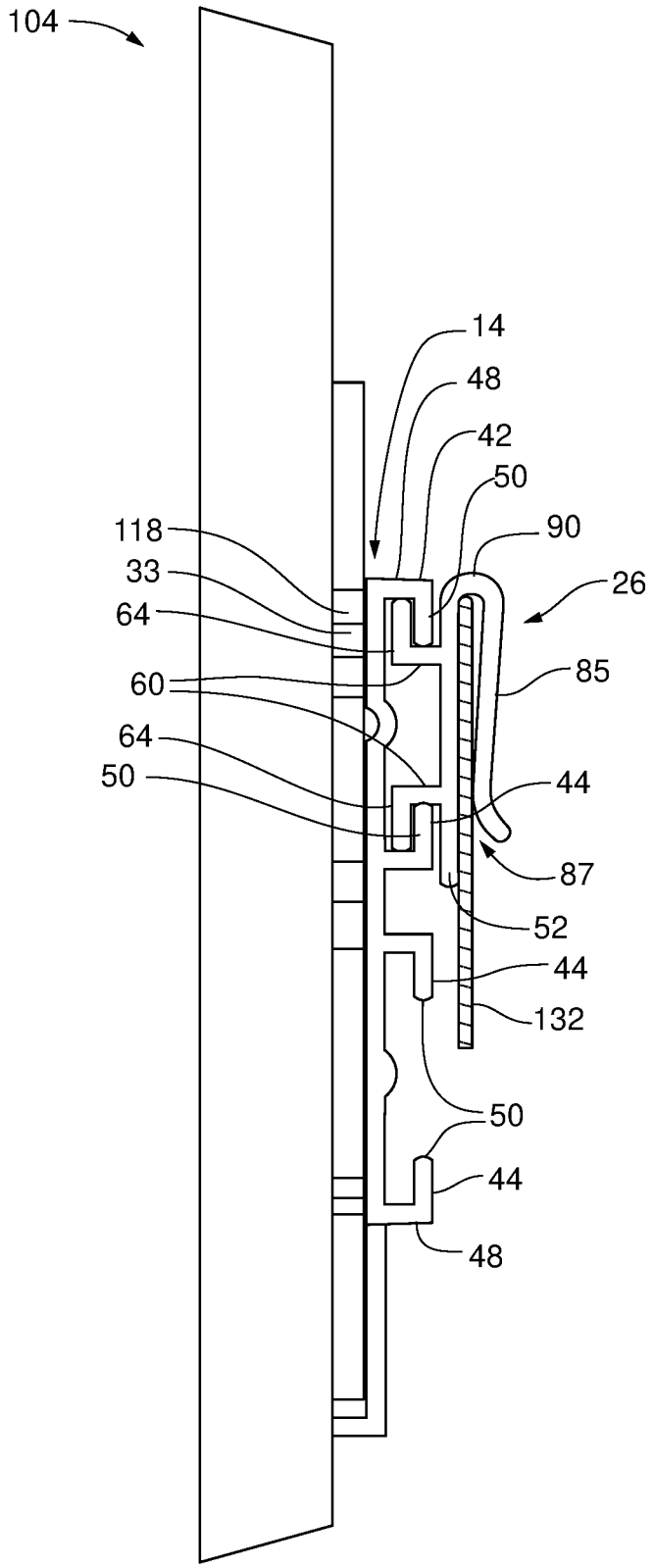
FIG. 16*b* is a side view of the second type of holder, sixth type of adapter, and second type of ESL as depicted in FIG. 16*a*, but shown fully assembled together and secured to a display bar.

When in use, the seventh adapter 28 is pushed against a shelf face 134 in the manner indicated by arrow 136, shown in FIG. 9*b*. The material characteristics of the adapter 28 are such that the top gripping panel 91 and bottom gripping panel 93 may be flexibly displaced away from each other in the manner indicated by arrows 138 and 140. In this manner the shelf 124 may be received into the gripping channel 95, with the top gripping panel 91 and bottom gripping panel 92 effectively sandwiching the shelf therebetween in a biased engagement in the manner shown in FIGS. 9*c*-9*d* and 17*b*.

By utilizing the adapters 16, 18, 20, 22, 24, 26, and 28 in the various manners described above, and in conjunction with holders 12 and 14, ESL devices such as ESL tags 102 and ESL displays 104 may be secured to and displayed from, a variety of structures and surfaces common to a commercial setting. A system 10 for displaying ESL tags and/or ESL displays may comprise of any number and variety of adapters and either one or both holders.

The many features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims.

What is claimed is:

1. A system for displaying an ESL device, the system comprising:

a first holder, the first holder comprised of a panel, the panel having a front face and a rear face, the front face configured for engagement to a first ESL device, the rear face having an upper adapter clasping member and a lower adapter clasping member that extend from the rear face of the panel to define a first rear-facing C-channel;

a first adapter type and a second adapter type, each adapter type having a different shape, each adapter type having a front adapter panel, an upper holder clasping member and a lower holder clasping member extend from a face of the front adapter panel, the first adapter type is comprised of the front adapter panel, a top panel and a rear panel, which form a U-shaped grasping channel, the U-shaped grasping channel configured to grasp a retaining bar therein;

the second adapter type is comprised of the front adapter panel and a surface engagement panel that intersect to form an angle of 120 degrees, the surface engagement panel defining at least one through hole, the at least one through hole adapted to receive a locking pin therethrough;

the upper holder clasping member of each adapter type comprising a first L-shaped adapter arm, the first L-shaped adapter arm having an upper arm that perpendicularly projects from the face, and a lower arm that perpendicularly projects from an end of the upper arm in a first direction, the front adapter panel, the upper arm and the lower arm of the upper holder clasping member defining an upper U-shaped receiving channel, the lower holder clasping member of each adapter type comprising a second L-shaped adapter arm, the second L-shaped adapter arm having an upper arm that perpendicularly projects from the face, and a lower arm that perpendicularly projects from an end of the upper arm in a second direction, the front adapter panel, the upper arm and the lower arm of the lower holder clasping member defining an lower U-shaped receiving channel, the second direction being opposite from the first direction;

each adapter type being configured for removeable engagement with the first holder, the upper adapter clasping member is constructed and arranged to be slidingly engaged into the upper U-shaped receiving channel and the lower adapter clasping member is constructed and arranged to be slidingly engaged into the lower U-shaped receiving channel.

2. The system of claim 1, wherein the front face of the panel comprises an upper ESL clasping member and a lower ESL clasping member that extend from the front face of the panel to define a front-facing C-channel.

3. The system of claim 2, wherein the upper ESL clasping member comprising a first L-shaped holder arm having an upper arm that perpendicularly projects from the front face, and a lower arm that perpendicularly projects from an end of the upper arm in a first direction, the lower ESL clasping member comprising a second L-shaped holder arm having an upper arm that perpendicularly projects from the front face, and a lower arm that perpendicularly projects from an end of the upper arm in a second direction, the second direction being opposite the first direction.

4. The system of claim 3, wherein when an ESL device is inserted into the front facing C-channel, the upper ESL clasping member engages at least a portion of a top surface of the ESL device and the lower ESL clasping member engages at least a portion of the bottom surface of the first ESL device.

5. The system of claim 4, wherein the first ESL device is an ESL tag.

6. The system of claim 5, further comprising a second holder, the second holder comprising a panel, the panel having a front face and a rear face, the front face configured for engagement to an ESL display, the rear face having a first upper adapter clasping member and a first lower adapter clasping member that extend from the rear face of the panel to define a first rear-facing C-channel, and a second upper adapter clasping member and a second lower adapter clasping member that extend from the rear face of the panel to define a second rear-facing C-channel;

each adapter type being configured for removeable engagement with either of the first rear facing C-channel or the second rear facing C-channel.

7. The system of claim 6, wherein the second holder includes a flared engagement tab that protrudes from the front face of the panel, and at least one retaining post that protrudes from the front face of the panel.

8. The system of claim 7, wherein the flared engagement tab and at least one retaining post are each constructed and arrange to be removably engaged to a correspondingly shaped opening of the ESL display.

9. The system of claim 1, further comprising a third adapter type, the third adapter type is comprised of the front adapter panel, a base panel, and a rear support panel arranged in a triangular cross-sectional shape, the front adapter panel and base panel defining a break therebetween, the break configured to receive a shelf securement tab therethrough.

10. The system of claim 9, further comprising a fourth adapter type, the fourth adapter type is in the form of a clip comprised of the front adapter panel, a base panel, and a rear support panel, the front adapter panel and base panel defining a break therebetween, the base panel having a curved lip adjacent to the break.

11. The system of claim 10, further comprising a fifth adapter type, the fifth adapter type is comprised of the front adapter panel and a surface engagement panel that intersect to form an angle of 90 degrees.

12. The system of claim 11, further comprising a sixth adapter type, the sixth adapter type is comprised of the front adapter panel, a rear support panel, and a transitional curve that links the front adapter panel and the rear support panel, a portion of the front adapter panel and a portion of the rear support panel defining a break, the portion of the front adapter panel and the portion of the rear support panel being biased against one another by the transitional curve.

13. The system of claim 12, further comprising a seventh adapter type, the seventh adapter type is comprised of the front adapter panel, a top gripping panel that extends at an angle of less than 90 degrees from the top of the front adapter panel, and a bottom gripping panel that extends at an angle of less than 90 degrees from the bottom of the front adapter panel.

* * * * *